US007259737B2

(12) United States Patent
Ono et al.

(10) Patent No.: US 7,259,737 B2
(45) Date of Patent: Aug. 21, 2007

(54) IMAGE DISPLAY APPARATUS CONTROLLING BRIGHTNESS OF CURRENT-CONTROLLED LIGHT EMITTING ELEMENT

(76) Inventors: Shinya Ono, c/o Kyocera Display Institute Co., Ltd., 1623-14, Shimotsuruma, Yamato-shi, Kanagawa, 242-8502 (JP); Takatoshi Tsujimura, c/o Kodak Japan Ltd., Bousei Building 3-20-12, Shin-Yokohama, Kohoku-ku, Yokohama-shi, Kanagawa, 222-0033 (JP); Yoshinao Kobayashi, c/o Kyocera Display Institute Co., Ltd., 1623-14, Shimotsuruma, Yamato-shi, Kanagawa 242-8502 (JP)

( * ) Notice: Subject to any disclaimer, the term of this patent is extended or adjusted under 35 U.S.C. 154(b) by 638 days.

(21) Appl. No.: 10/844,355

(22) Filed: May 13, 2004

(65) Prior Publication Data

US 2004/0252089 A1 Dec. 16, 2004

(30) Foreign Application Priority Data

May 16, 2003 (JP) ..... 2003-139478

(51) Int. Cl.
*G09G 3/32* (2006.01)

(52) U.S. Cl. ..... 345/82; 345/204

(58) Field of Classification Search ..... 345/36, 345/45, 48, 76, 82, 84, 204, 205; 315/169.1, 315/169.3, 169.4

See application file for complete search history.

(56) References Cited

U.S. PATENT DOCUMENTS 6,229,506 B1 5/2001 Dawson et al.
6,452,341 B1 * 9/2002 Yamauchi et al. ..... 315/169.1
6,680,577 B1 * 1/2004 Inukai et al. ..... 315/169.3
6,710,548 B2 * 3/2004 Kimura ..... 315/169.3
6,858,991 B2 * 2/2005 Miyazawa ..... 315/169.3
6,870,192 B2 * 3/2005 Yamazaki et al. ..... 257/79
6,919,868 B2 * 7/2005 Tam ..... 345/76
7,053,875 B2 * 5/2006 Chou ..... 345/92
7,061,452 B2 * 6/2006 Inoue et al. ..... 345/76
2002/0000576 A1 * 1/2002 Inukai ..... 257/202
2003/0052843 A1 * 3/2003 Yamazaki et al. ..... 345/82
2003/0062844 A1 * 4/2003 Miyazawa ..... 315/169.3
2003/0063053 A1 * 4/2003 Yamazaki et al. ..... 345/82
2003/0090446 A1 * 5/2003 Tagawa et al. ..... 345/76
2003/0142047 A1 * 7/2003 Inoue et al. ..... 345/82
2004/0066363 A1 * 4/2004 Yamano et al. ..... 345/98
2004/0080474 A1 * 4/2004 Kimura ..... 345/82
2005/0030264 A1 * 2/2005 Tsuge et al. ..... 345/76
2005/0116907 A1 * 6/2005 Miyazawa ..... 345/76
2005/0168491 A1 * 8/2005 Takahara et al. ..... 345/690
2006/0061293 A1 * 3/2006 Kobayashi et al. ..... 315/169.3
2006/0066535 A1 * 3/2006 Shirasaki et al. ..... 345/76
2006/0103684 A1 * 5/2006 Yamazaki et al. ..... 345/690
2007/0070680 A1 * 3/2007 Kimura et al. ..... 365/145

* cited by examiner

*Primary Examiner*—Richard Hjerpe
*Assistant Examiner*—Jean Lesperance
(74) *Attorney, Agent, or Firm*—Birch, Stewart, Kolasch & Birch, LLP

(57) ABSTRACT

An image display apparatus according to the present invention includes a data line that supplies a voltage determined based on emission brightness, a first switching unit that controls writing of the voltage supplied from the data line, a driver element that controls a current flowing through a current-controlled light emitting element, an organic electroluminescence element that emits light of brightness corresponding to current applied, a reference-voltage writing unit that supplies a predetermined reference voltage, and a threshold-voltage detecting unit that detects a threshold voltage of the driver element.

16 Claims, 23 Drawing Sheets

IMAGE DISPLAY APPARATUS CONTROLLING BRIGHTNESS OF CURRENT-CONTROLLED LIGHT EMITTING ELEMENT

CROSS-REFERENCE TO RELATED APPLICATIONS

This Nonprovisional application claims priority under 35 U.S.C. 119(a) on patent application Ser. No. 2003-139478 filed in Japan on May 16, 2003, the subject matter of which is hereby incorporated by reference.

BACKGROUND OF THE INVENTION

1) Field of the Invention

The present invention relates to an active-matrix-type image display apparatus controlling brightness of a current-controlled light emitting element, and more particularly, to an image display apparatus that suppresses a decrease in refresh rates to perform high-quality image display.

2) Description of the Related Art

An organic electro-luminescence (EL) display apparatus using an organic light-emitting-diode (LED) that emits light autonomously is getting an attention as a next generation image display apparatus, because it does not require a back light that is necessary in a liquid crystal display (LCD) apparatus, which makes it most suitable for reducing thickness of the apparatus, and does not have any limitation in the angle of visibility. Unlike the liquid crystal display apparatus in which a liquid crystal cell is controlled by a voltage, the organic LED used for the organic EL display apparatus has a mechanism that the brightness of each light emitting element is controlled by a current.

In the organic EL display apparatus, a simple (passive) matrix type and an active matrix type can be employed as a drive system. The former has a simple configuration, but has a problem of realization of a large and high definition display. Therefore, recent research and development on the organic EL display apparatus is focused on the active matrix type image display apparatus that controls electric current flowing in a light emitting element in a pixel by a driver element having a device such as a thin film transistor (TFT) provided in the pixel.

The driver element is directly connected to the organic LED, and becomes ON at the time of displaying an image, to supply the current to the organic LED, so that the organic LED emits light. Therefore, when the image display apparatus is used for long time, and threshold voltage of the TFT included in the driver element fluctuates, even when the voltage supplied into the pixel is constant, the current flowing through the driver element fluctuates, and hence the current flowing through the organic LED also fluctuates. Therefore, the emission brightness of the organic LED becomes nonuniform, thereby deteriorating the image quality of the displayed image.

To cope with the problem, an image display apparatus having a compensation circuit that makes up for the fluctuations in the threshold voltage of the driver element is necessary. FIG. 16 a circuit diagram of a pixel circuit having such compensation circuit according to a conventional technology. The conventional image display apparatus includes a data line 310 for supplying data voltage corresponding to the emission brightness and zero voltage, a select line 320, a reset line 330, a merge line 340, and a power line $V_{DD}$. Further, the image display apparatus includes a TFT 360, a TFT 365, a TFT 370, a TFT 375, a capacitor 350, a capacitor 355, and an organic LED 380. The TFT 365 serves as a driver element, and the capacitor 350 and the capacitor 355 are connected to a gate electrode of the TFT 365. A predetermined voltage from among the data voltages charged in the capacitor 350 and the capacitor 355 becomes the gate-source voltage of the TFT 365, and the current corresponding to the gate-source voltage flows through the TFT 365.

FIGS. 17A to 17D are circuit diagrams for illustrating operating processes of the pixel circuit shown in FIG. 16. In the pixel circuit in the conventional technology, the organic LED 380 emits light at a light emitting step after the data voltage is written through a zero voltage applying step and a threshold voltage detecting step. Solid line in FIGS. 17A to 17D indicates a current flowing region, and broken line indicates a non-current flowing region.

FIG. 17A depicts the zero voltage applying step. The voltage applied to the data line 310 is changed from the data voltage to the zero voltage. Since, when a data driver controlling the applied voltage to the data line 310 changes the applied voltage to the data line 310, a certain period of time is required in the pixel circuit away from the data driver until the applied voltage becomes stable, the zero voltage applying step is necessary. After the applied voltage to the data line 310 is stabilized at the zero voltage, the zero voltage is supplied to the capacitor 350 by setting the select line 320 to a low level and the TFT 360 to the ON state.

FIG. 17B depicts the threshold voltage detecting step. By setting the reset line 330 to a low level and the TFT 370 to the ON state, the gate and the drain of the TFT 365 become conductive to each other. The TFT 360 becomes the ON state, and the zero voltage is supplied from the data line 310, to the capacitor 350. By setting the merge line 340 to a low level, the transistor 375 becomes the ON state, so that the current flows to the TFT 365. When the gate-drain voltage of the TFT 365 becomes the threshold voltage, the TFT 365 becomes the OFF state, thereby finishing detection of the threshold voltage. During the threshold voltage detecting step, the zero voltage is applied to the data line 310.

Then, control proceeds to a data writing step shown in FIG. 17C. In this case, the voltage applied to the data line 310 is changed to the data voltage. After the applied voltage to the data line 310 is stabilized at the data voltage, the select line 320 becomes a low level, and the TFT 360 becomes the ON state, and hence the data voltage is supplied from the data line 310 to the capacitor 350. Thereafter, the TFT 360 becomes the OFF state, to finish the data writing step, and control proceeds to the light emitting step shown in FIG. 17D.

As shown in FIG. 17D, by setting the merge line 340 to the low level and the TFT 375 to the ON state, the current corresponding to the gate-source voltage flows to the TFT 365, so that the organic LED 380 emits light. Since the gate-source voltage of the TFT 365 includes the threshold voltage detected at the threshold voltage detecting step, even when fluctuations occur in the threshold voltage of the TFT 365, desired current can be allowed to flow to the organic LED 380, regardless of the deterioration of the TFT 365 (see, for example, U.S. Pat. No. 6,229,506 (FIG. 3)).

However, in the pixel circuit shown in FIG. 16, the time required for displaying one screen increases, thereby causing a problem of decrease in refresh rate, the number of times for displaying the screen in one second. The decrease in the refresh rate is caused by the fact that the data line 310 supplies the data voltage and the zero voltage.

In order to detect the threshold voltage stably, the state in which the zero voltage is supplied to the capacitor 350 is required. As described above, after the applied voltage to the data line 310 is changed from the data voltage to the zero voltage by the data driver, the zero voltage is supplied from the data line 310 to the capacitor 350. However, certain time is required for the applied voltage to the data line 310 to be changed from the data voltage to the zero voltage and stabilized at the zero voltage. Therefore, the zero voltage applying step is conventionally necessary. Further, certain time is also required until the applied voltage to the data line 310 is changed from the zero voltage to the data voltage and stabilized at the data voltage. Therefore, starting of the data writing step takes time, too.

In the pixel circuit away from the data driver, when the voltage applied to the data line 310 is changed, more time is required until such a voltage becomes stable, as compared with a pixel circuit closer to the data driver. Further, when a signal delay occurs in the data line 310, more time is required for supplying the voltage from the data line 310.

In the image display apparatus according to the conventional technology, it is necessary to take the period until the applied voltage to the data line 310 becomes stable into consideration, in order to start the threshold voltage detecting step and the data writing step. Therefore, long time is necessary until the data writing step finishes, and hence the light emitting time cannot be ensured, and the refresh rate drops inevitably. Particularly, in the high definition image display apparatus, since it is necessary to reduce the time until the data writing step finishes, high-definition image quality cannot be achieved with the image display apparatus according to the conventional technology. Furthermore, since the threshold voltage detecting step has to be shortened to keep the optimum value of the refresh rate, the fluctuations in the threshold voltage of the driver element cannot be compensated sufficiently, thereby making it difficult to keep the uniformity in the image quality.

SUMMARY OF THE INVENTION

The image display apparatus according to one aspect of the present invention includes a display pixel that includes a current-controlled light emitting element that emits light of brightness corresponding to current applied; a driver element that includes a thin film transistor, and controls the current flowing through the current-controlled light emitting element; a data line that supplies a voltage determined based on emission brightness; a first switching unit that controls writing of the voltage supplied from the data line; a first capacitor having a first electrode electrically connected to a gate electrode of the driver element, to hold a gate voltage of the driver element; a reference-voltage writing unit that includes a supply source provided separately from the data line for supplying a predetermined reference voltage to a second electrode of the first capacitor, and a second switching unit that controls electrical conduction between the supply source and the second electrode of the first capacitor; and a threshold-voltage detecting unit that detects a threshold voltage of the driver element, including a third switching unit that controls electrical conduction between the gate electrode and a drain electrode of the driver element, and a capacitance for supplying charges to the drain electrode of the driver element.

The image display apparatus of an interlace system according to another aspect of the present invention includes a display pixel that includes a current-controlled light emitting element that emits light of brightness corresponding to current applied; a driver element that includes a thin film transistor, and controls the current flowing through the current-controlled light emitting element; a reference-voltage writing unit that writes the reference voltage in the first capacitor, including a first capacitor that holds a gate-source voltage of the thin film transistor, a data line that supplies a voltage determined based on emission brightness and a predetermined reference voltage alternately, and a first switching unit that controls electrical conduction between the data line and the first capacitor; and a threshold-voltage detecting unit that detects a threshold voltage of the driver element, including a second switching unit that controls electrical conduction between a gate electrode and a drain electrode of the driver element, and a capacitance that is formed by the current-controlled light emitting element, and supplies electric charges accumulated to the drain electrode of the driver element.

The other objects, features, and advantages of the present invention are specifically set forth in or will become apparent from the following detailed description of the invention when read in conjunction with the accompanying drawings.

DETAILED DESCRIPTION

Exemplary embodiments of an image display apparatus controlling brightness of current-controlled light emitting element according to the present invention will be explained in detail with reference to the accompanying drawings. The present invention is not limited to the embodiments.

In a first embodiment of the present invention, image display is performed by repeating a preprocessing step, a threshold voltage detecting step of detecting a threshold voltage of the driver element at which a reference voltage is written by a data line and a reference-voltage writing unit provided separately from a first switching unit, a data writing step of writing the data voltage, and a light emitting step of supplying the current corresponding to the data voltage to the current-controlled light emitting element so as to emit light.

Figure 1:
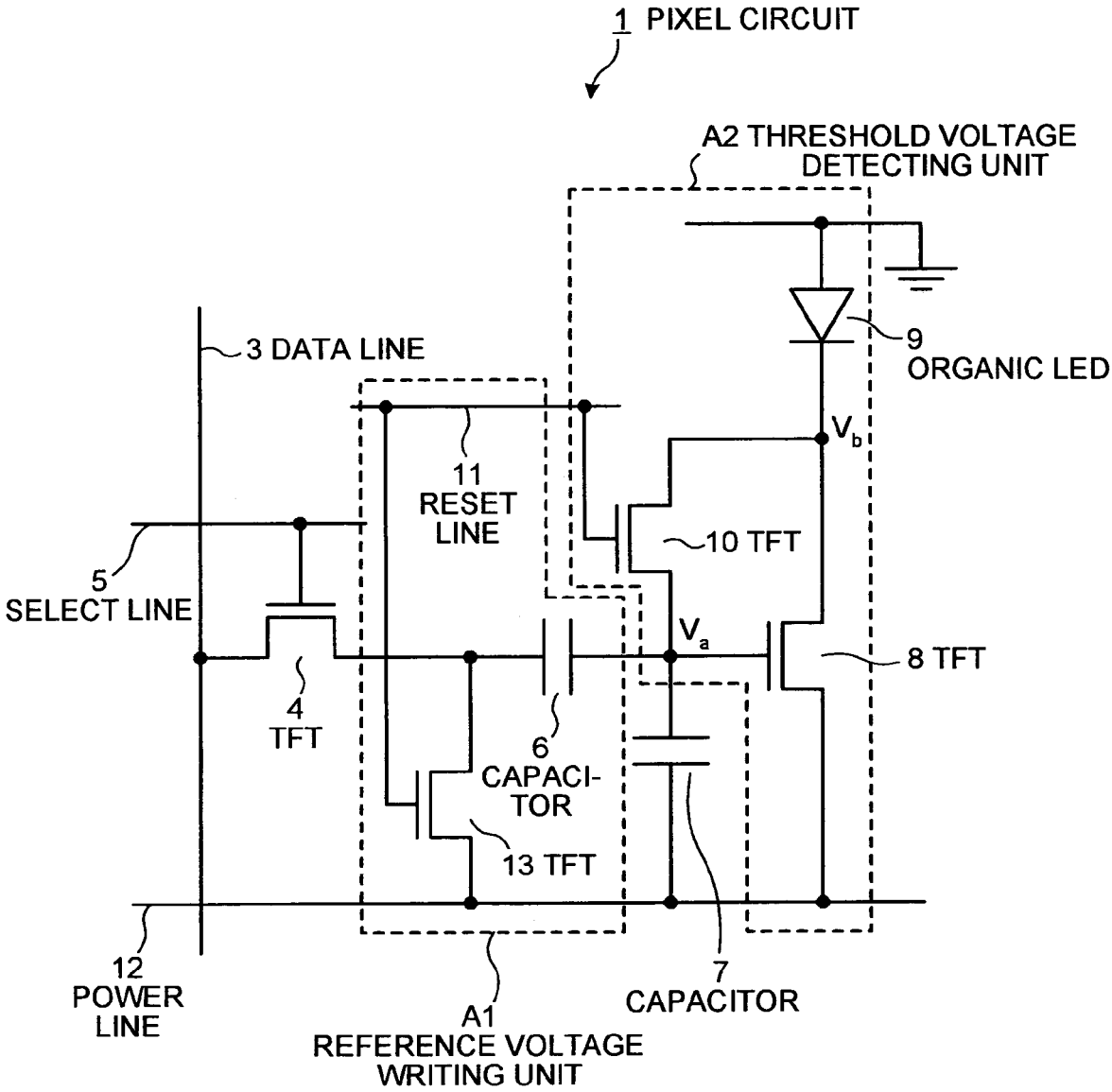
FIG. 1 is a circuit diagram of a pixel circuit according to a first embodiment of the present invention.

FIG. 1 is a circuit diagram of a pixel circuit according to the first embodiment. The image display apparatus according to the first embodiment is constructed by arranging the pixel circuits shown in FIG. 1 in a matrix form.

The pixel circuit in the first embodiment includes a data line 3 for supplying the data voltage defined based on the emission brightness, a TFT 4 being a first switching unit that controls supply of the data voltage, a TFT 8 being a driver element, and an organic LED 9 being the current-controlled light emitting element. The pixel circuit also includes capacitors 6 and 7 that hold the supplied voltage. Further, the pixel circuit includes a reference-voltage writing unit A1 that writes a predetermined reference voltage, and a threshold-voltage detecting unit A2 that detects the threshold voltage of the TFT 8. For the brevity of explanation, for the TFT 8, an electrode connected to the organic LED 9 is designated as the drain electrode, and the other electrode is designated as the source electrode.

The data line 3 supplies the data voltage defined based on the emission brightness of the organic LED 9. The TFT 4 is connected to the data line 3, to control write of the data voltage supplied from the data line 3. A select line 5 controls the driven state of the TFT 4, and by setting the select line 5 to a high level, the TFT 4 becomes the ON state, and becomes the OFF state by setting the select line 5 to a low level.

The zero voltage is supplied to the capacitor 6 arranged between the TFT 4 and the TFT 8 at the threshold voltage detecting step-, and the data voltage is supplied at the data writing step. The capacitor 7 is connected to the TFT 8 and the capacitor 6 with one electrode, to hold the data voltage stably. At the light emitting step, a predetermined percent voltage of the data voltage held by the capacitors 6 and 7 is applied to the gate electrode of the TFT 8.

The TFT 8 serves as the driver element, and controls the light emission of the organic LED 9 and the brightness at the time of light emission, by allowing the current corresponding to the gate-source voltage of the TFT 8 to flow. At this time, the gate-source voltage of the TFT 8 takes a value including the predetermined percent voltage of the data voltage and the threshold voltage detected at the threshold voltage detecting step.

The reference-voltage writing unit A1 has a function of supplying the zero voltage as the predetermined reference voltage, to the capacitor 6 at the threshold voltage detecting step. The reference-voltage writing unit A1 is provided separately from the data line 3 and the TFT 4, and has a power line 12 as a supply source of the reference voltage, a TFT 13 as a second switching unit, and a reset line 11 as a first scan line. The power line 12 supplies the zero voltage as the reference voltage, and the TFT 13 is connected to the power line 12, to control the electrical conduction between the power line 12 and the capacitor 6. The TFT 13 is controlled by the reset line 11. At the threshold voltage detecting step, when the TFT 13 becomes the ON state, the power line 12 supplies the zero voltage to the capacitor 6. Since the image display apparatus according to the first embodiment includes the reference-voltage writing unit A1, it is not necessary to change the applied voltage to the data line 3 in order to perform the threshold voltage detecting step. As a result, the zero voltage applying step, which has heretofore been necessary, can be eliminated, and the time until the data writing step is started can be reduced.

The threshold-voltage detecting unit A2 detects the threshold voltage of the TFT 8, being the driver element, and has a TFT 10 as a third switching unit, the organic LED 9, and the power line 12. The TFT 10 controls electrical conduction between the gate electrode and the drain electrode of the TFT 8, and becomes the ON state at the threshold voltage detecting step. The driven state of the TFT 10 is controlled by the reset line 11. The TFT 10 and the TFT 13 are driven at the same timing, and hence it is explained herein that the two are controlled by the same reset line 11, but may be controlled by a separate scan line.

The organic LED 9 is originally a current-controlled light emitting element that emits light with brightness corresponding to the current flowing when the TFT 8 is in the ON state, but in the threshold-voltage detecting unit A2, the organic LED 9 serves as a capacitor for supplying electric charges to the drain electrode of the TFT 8. This is because the organic LED 9 can be considered to be electrically equivalent to a light emitting diode, and when a potential difference is provided in the forward direction, the current flows to emit light, and on the other hand, when a potential difference is provided in the opposite direction, the organic LED 9 stores electric charges corresponding to the potential difference.

The power line 12 is originally for supplying the current when the organic LED 9 emits light, but in the threshold-voltage detecting unit A2, it has a function of inverting the polarity of the voltage with respect to the polarity at the time of light emission to allow the current to flow to the TFT 8 from the source electrode to the drain electrode, so that the organic LED 9 stores the electric charges. Since the power line 12 indicates zero level at the threshold voltage detecting step, it also functions as a supply source for the reference-voltage writing unit A1.

Figure 2:
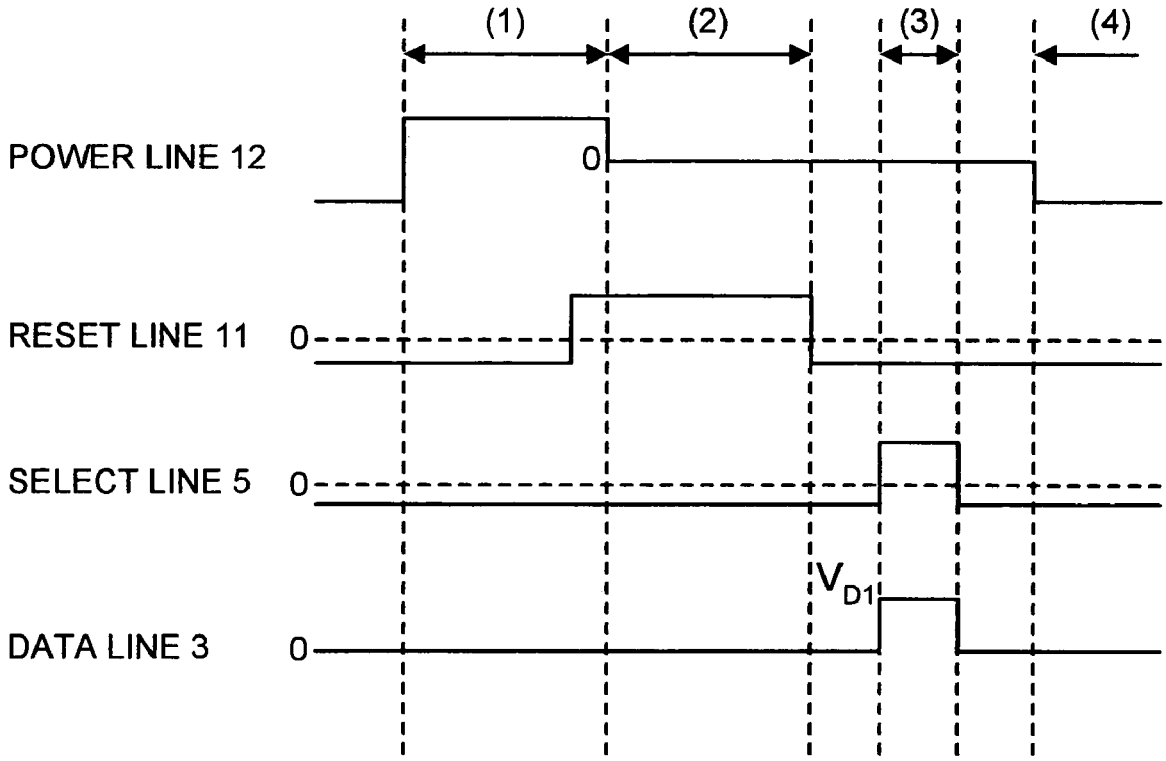
FIG. 2 is a timing chart of the pixel circuit shown in FIG. 1.
Figure 3A:
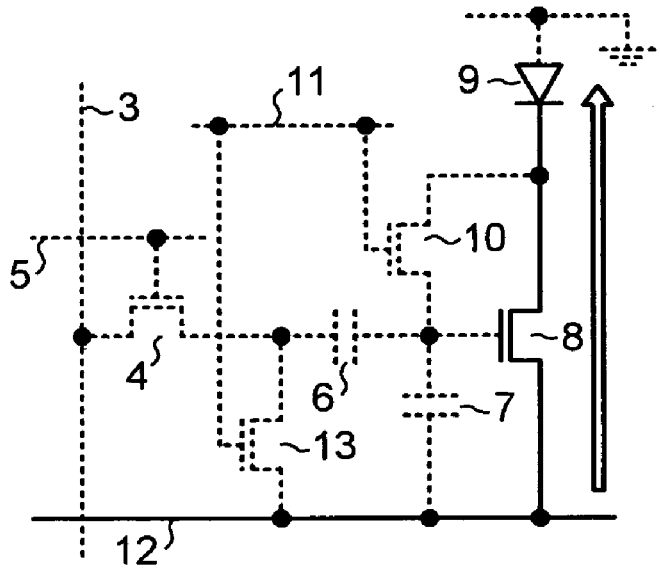
FIG. 3A is a circuit diagram for illustrating an operating process of the pixel circuit in a period (1) shown in FIG. 2.
Figure 3B:
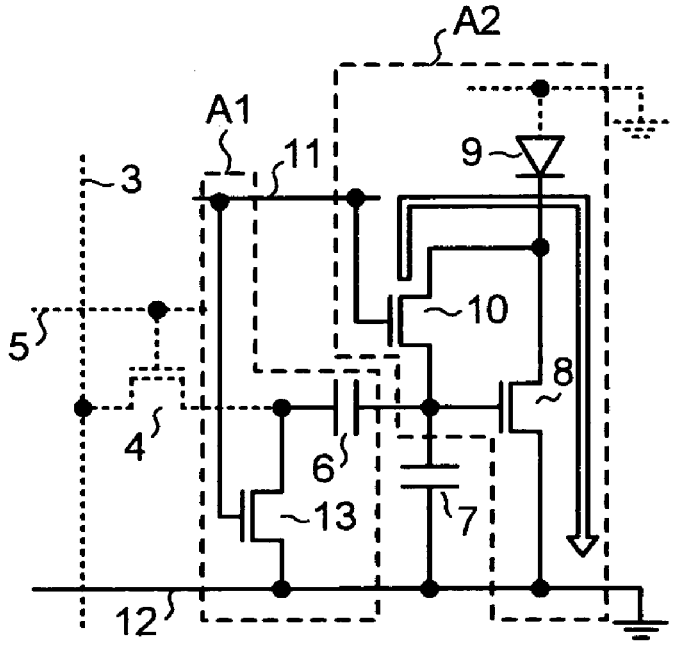
FIG. 3B is a circuit diagram for illustrating an operating process of the pixel circuit in a period (2) shown in FIG. 2.
Figure 3C:
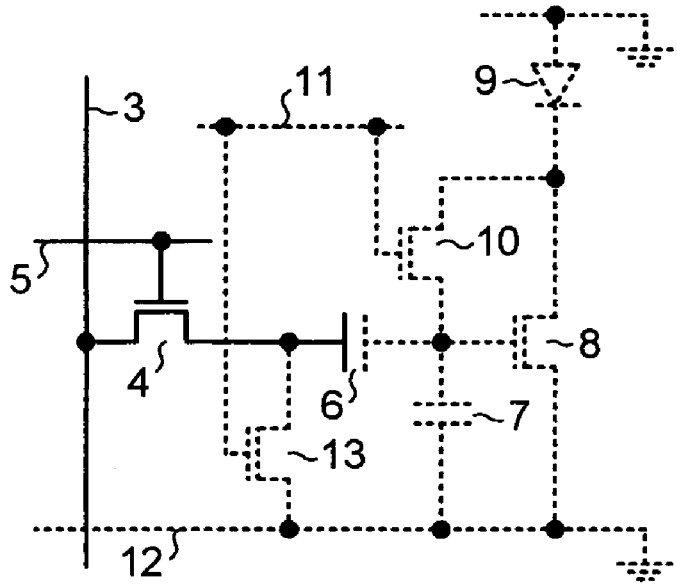
FIG. 3C is a circuit diagram for illustrating an operating process of the pixel circuit in a period (3) shown in FIG. 2.
Figure 3D:
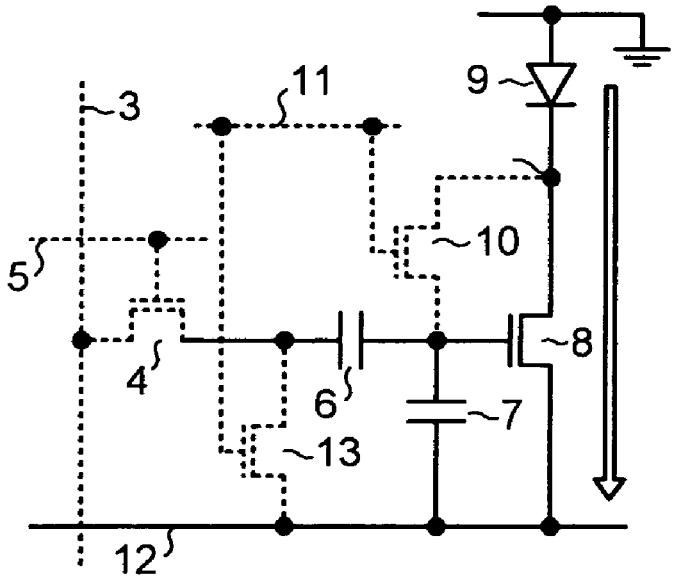
FIG. 3D is a circuit diagram for illustrating an operating process of the pixel circuit in a period (4) shown in FIG. 2.

The preprocessing step, the threshold voltage detecting step, the data writing step, and the light emitting step will be explained, as the operation of the image display apparatus according to the first embodiment. The threshold voltage detecting step is executed by the operation of the reference-voltage writing unit A1 and the threshold-voltage detecting unit A2. FIG. 2 is a timing chart of the pixel circuit shown in FIG. 1. FIG. 3A is a circuit diagram for illustrating an operating process of the pixel circuit in a period (1) shown in FIG. 2; FIG. 3B is a circuit diagram for illustrating an operating process of the pixel circuit in a period (2); FIG. 3C is a circuit diagram for illustrating an operating process of the pixel circuit in a period (3); and FIG. 3D is a circuit diagram for illustrating an operating process of the pixel circuit in a period (4). A solid line indicates a current flowing region, and a broken line indicates a non-current flowing region. The current flowing direction is indicated by the arrow.

The preprocessing step will be explained with reference to FIGS. 2 and 3A. At the preprocessing step, the current is made to flow through the TFT 8 in a direction opposite to the direction at the time of light emission so that the organic LED 9 stores electric charges, as the preprocessing for the threshold voltage detection for the TFT 8. As shown in FIG. 2, by changing the voltage polarity of the power line 12 connected to the source electrode of the TFT 8 from the low level to the high level, the current flows from the source electrode to the drain electrode of the TFT 8. The current also flows to the organic LED 9 connected to the TFT 8 in a direction opposite to the direction at the time of light emission, and hence the organic LED 9 serves as a capacitor and stores positive charges. The TFT 4, the TFT 10, and the TFT 13 are controlled so as to be in the OFF state.

At the threshold voltage detecting step, the reference-voltage writing unit A1 supplies the zero voltage, being the predetermined reference voltage, to the capacitor 6, in order to stably detect the threshold voltage. On the other hand, the threshold-voltage detecting unit A2 discharges the charges stored in the organic LED 9 at the preprocessing step, so as to detect the threshold voltage of the TFT 8 by dropping the gate-source voltage of the TFT 8 to a value equal to the threshold voltage.

As shown in FIGS. 2 and 3B, at the threshold voltage detecting step, the reset line 11 is set to the high level, and the TFT 10 and the TFT 13 are set to the ON state, so that the reference-voltage writing unit A1 and the threshold-voltage detecting unit A2 are operated. The reference-voltage writing unit A1 sets the applied voltage to the power line 12 to zero level, in order to allow the power line 12 to serve as the supply source, and supplies the zero voltage to the capacitor 6 from the power line 12 via the TFT 13, during the threshold voltage detecting step. The zero voltage is also supplied to the capacitor 7 connected to the power line 12. During the threshold voltage detecting step, since the zero voltage is held in one of the electrodes of the capacitors 6 and 7, the threshold voltage of the TFT 8 can be stably detected by the threshold-voltage detecting unit A2 connected to the gate electrode of the TFT 8 and the other of the electrodes of the capacitors 6 and 7. Since the reference voltage writing unit A1 supplies the reference voltage to the capacitor 6, it is not necessary to change the applied voltage to the data line 3 in order to execute the threshold voltage detecting step.

On the other hand, the threshold-voltage detecting unit A2 sets the TFT 10 to the ON state, so that the gate electrode and the drain electrode of the TFT 8 become conductive to each other. At this time, positive charges move from the organic LED 9 so that the voltage $V_a$ and the voltage $V_b$ at the connection parts shown in FIG. 1 become equal, and as a result, a predetermined gate-source voltage is generated in the TFT 8 and the current flows. Since the current flows, the absolute value of the positive charges stored in the organic LED 9 gradually decreases, and $V_a$ and $V_b$ drop with the same voltage held therein. When the gate-source voltage of the TFT 8 drops to a value equal to the threshold voltage, the TFT 8 becomes the OFF state, so that the gate voltage of the TFT 8 is kept at the value of the threshold voltage. After detection of the threshold voltage of the TFT 8 finishes, the reset line 11 is set to the low level, to set the TFT 10 and the TFT 13 to the OFF state, thereby finishing the threshold voltage detecting step.

At the data writing step, by setting the TFT 4 to the ON state, data voltage $V_{D1}$ is written from the data line 3. As shown in FIGS. 2 and 3C, at the data writing step, the data voltage $V_{D1}$ is applied to the data line 3, and by setting the select line 5 to the high level, the TFT 4 becomes the ON state. When the TFT 4 becomes the ON state, the data line 3 and the capacitor 6 become conductive to each other to supply the data voltage $V_{D1}$, and the data voltage $V_{D1}$ is held stably by the capacitors 6 and 7. Thereafter, the select line 5 is set to the low level, to set the TFT 4 to the OFF state, thereby finishing the data writing step.

At the light emitting step, the current flows through the TFT 8 and the organic LED 9, based on the voltage held by the capacitor 7, and the organic LED 9 emits light with predetermined brightness.

As shown in FIGS. 2 and 3D, at the light emitting step, the applied voltage from the power line 12 is changed to the low level, and a voltage lower than that of the drain electrode is applied to the source electrode of the TFT 8 connected to the power line 12. Further, since a predetermined percent voltage of the data voltage $V_{D1}$ stored by the capacitor 7 is supplied to the gate electrode of the TFT 8, the TFT 8 becomes the ON state, and hence the current corresponding to the gate-source voltage of the TFT 8 flows. Here, since the gate-source voltage of the TFT 8 has a value including the threshold voltage of the TFT 8 detected at the threshold voltage detecting step, even when the threshold voltage of the TFT 8 fluctuates, the current flowing through the TFT 8 does not drop. Since the current flowing through the TFT 8 also flows through the organic LED 9, the organic LED 9 emits light with desired brightness. At this step, the TFT 4, the TFT 10, and the TFT 13 are in the OFF state.

The advantages of the image display apparatus according to the first embodiment will be explained. Since the image display apparatus according to the first embodiment includes the threshold-voltage detecting unit A2, it can compensate fluctuations in the threshold voltage. Therefore, the value of the current flowing into the organic LED 9 does not fluctuate, and hence the organic LED 9 emits light with desired brightness, thereby suppressing deterioration in the image quality of the image display apparatus. The gate voltage $V_g$ of the TFT 8 at the time of starting the light emitting step is expressed by $$V_g = V_{thl} + \frac{C_1}{C_1 + C_2} \cdot V_{Dl} \tag{1}$$

where $V_{th1}$ is the threshold voltage of the TFT 8, $C_1$ is the capacitance of the capacitor 6, and $C_2$ is the capacitance of the capacitor 7. The current $I_{ds}$ flowing through the TFT 8 is expressed, based on the gate-source voltage of the TFT 8, by $$I_{ds} = \frac{\hat{a}}{2}\left(V_{th1} + \frac{C_1}{C_1 + C_2} \cdot V_{D1} - V_{th1}\right)^2 = \frac{\hat{a}}{2}\left(\frac{C_1}{C_1 + C_2} \cdot V_{D1}\right)^2 \quad (2)$$

where, β is a predetermined constant. Since $I_{ds}$ does not include the threshold voltage $V_{th1}$ of the TFT 8, $I_{ds}$ does not change according to fluctuations in the threshold voltage. Further, $I_{ds}$ depends on the ratio of the capacitance of the capacitors 6 and 7, and when the capacitance ratio is constant, $I_{ds}$ also takes a constant value. Here, since the capacitors 6 and 7 are normally produced in the same process, even if a misregistration of a mask pattern occurs at the time of production, the difference in the capacitance substantially has the same ratio in the capacitors 6 and 7. Therefore, even when a difference occurs, a substantially constant value can be maintained as the value of $(C_1/(C_1+C_2))$. Even when a manufacturing error occurs, the value of $I_{ds}$ can be maintained at a substantially constant value.

Therefore, the value of the current flowing through the TFT 8 can keep a constant value, and the current flowing into the organic LED 9 does not fluctuate, and hence the organic LED 9 emits light with desired brightness. As a result, the image display apparatus according to the first embodiment can perform high-quality image display over a long period of time.

The image display apparatus according to the first embodiment includes the reference-voltage writing unit A1 provided separately from the data line 3 and the TFT 4, and the reference-voltage writing unit A1 supplies predetermined reference voltage to the capacitor 6 at the threshold voltage detecting step. Therefore, it is not necessary that the data line 3 supplies the reference voltage at the threshold voltage detecting step, and only supplies the data voltage $V_{D1}$ at the voltage writing step. Therefore, it is not necessary to change the applied voltage to the data line 3 in order to perform the threshold voltage detecting step, and hence the zero voltage applying step, which has been heretofore necessary, can be eliminated.

Since the reference voltage is supplied by the reference-voltage writing unit A1, the data line 3 can have an optional voltage at the threshold voltage detecting step. Therefore, at the threshold voltage detecting step, the applied voltage to the data line 3 is made to change from the zero voltage to the data voltage $V_{D1}$, and the applied voltage to the data line 3 can be stabilized at the data voltage $V_{D1}$ by the end of the threshold voltage detecting step. By operating the image display apparatus in this manner, the data line 3 can stably supply the data voltage, even in a pixel circuit away from the data driver that controls the applied voltage to the data line 3. Further, even when a signal delay occurs in the data line 3, it can be prevented that start of the data writing step is delayed. As a result, the image display apparatus according to the first embodiment can shorten the time until starting the data writing step.

In order to stably detect the threshold voltage, it is necessary that the zero voltage is supplied to the capacitor 6 at the threshold voltage detecting step. In the image display apparatus according to the first embodiment, since the TFT 10 and the TFT 13 are controlled by the reset line 11, write of the zero voltage by the reference-voltage writing unit A1 and detection of the threshold voltage by the threshold-voltage detecting unit A2 can be started at the same time. As a result, it is not necessary to stagger the start of operation of the reference-voltage writing unit A1 and the threshold-voltage detecting unit A2, thereby preventing wasting operation time due to the stagger.

The image display apparatus according to the first embodiment can eliminate the time required for stabilizing the applied voltage to the data line 3, such as the zero voltage applying step, and as a result, the time until starting the threshold voltage detecting step, and the time until starting the data writing step can be shortened. Therefore, predetermined light emitting time can be ensured, and the refresh rate can be kept at an optimum value. Further, the time for the threshold voltage detecting step can be ensured, thereby enabling accurate detection of the threshold voltage of the TFT 8.

The timing to proceed from the data writing step to the light emitting step and the timing to proceed from the light emitting step to the preprocessing step can be optionally controlled by adjusting the level of the applied voltage to the power line 12. By such an adjustment of the timing, the ratio of the time for displaying an image to the time for not displaying the image can be optionally controlled.

Figure 4:
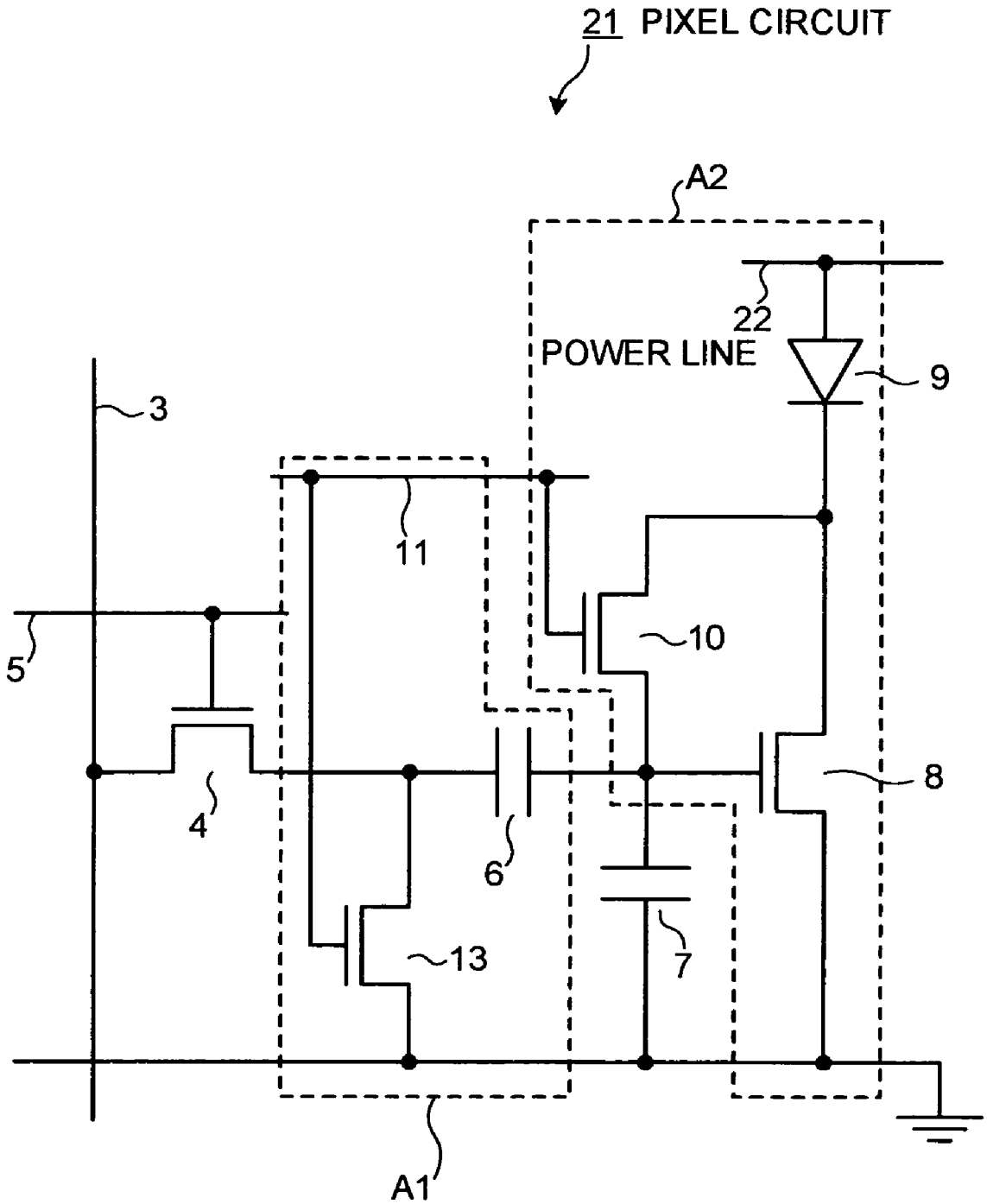
FIG. 4 is another circuit diagram of the pixel circuit according to the first embodiment.

The pixel circuit uses the power line 12, which indicates zero level at the threshold voltage detecting step, as the supply source constituting the reference-voltage writing unit A1. However, since a scan line that supplies the zero voltage as the reference voltage at the threshold voltage detecting step can function as the supply source, a line in common use connected to the ground, as shown in FIG. 4, can be substituted for the power line 12 as the supply source. Since a power line 22 is connected to the anode side of the organic LED 9, a voltage indicating the polarity opposite to the voltage applied to the power line 12 shown in FIG. 2 is applied to the power line 22.

It is explained above that, in the image display apparatus according to the first embodiment, the TFT 13 constituting the reference-voltage writing unit A1 and the TFT 10 constituting the threshold-voltage detecting unit are controlled by the reset line 11, but these may be controlled by separate scan lines. At the threshold voltage detecting step, the threshold voltage of the TFT 8 can be detected, so long as the TFT 10 and the TFT 13 are both in the ON state during the period required for detecting the threshold voltage of the TFT 8. Therefore, the TFT 10 and the TFT 13 may be controlled by separate scan lines.

In the first embodiment, the predetermined reference voltage is designated as the zero voltage, but the predetermined reference voltage is not limited to the zero voltage, and may be a value lower than the voltage value corresponding to the emission brightness of the organic LED 9. However, when the reference voltage is not the zero voltage, it is necessary to set the data voltage applied to the data line 3, taking into consideration a difference between the voltage value corresponding to the emission brightness of the organic LED 9 and the reference voltage value.

In the first embodiment, the image display can be performed by any of a progressive method and an interlace method, but in a second embodiment of the present invention, image display is performed by the interlace method.

The interlace method is for performing one display in such a manner that while, for example, a pixel circuit in the odd level performs display corresponding to the picture signal (hereinafter, "white display"), a pixel circuit in the even level does not emit light (hereinafter, "black display"), and thereafter, the pixel circuit in the even level performs white display, and the pixel circuit in the odd level performs black display. In other words, by displaying a screen alternately by the odd level and the even level, one screen is displayed. In this interlace method, the data voltage supplied to the pixel circuit performing white display, and the zero voltage supplied to the pixel circuit performing black display are applied to the data line alternately a plurality of times during one display period. In the second embodiment, the zero voltage to be applied to the data line is used as the reference voltage, to detect the threshold voltage of the driver element.

Figure 5:
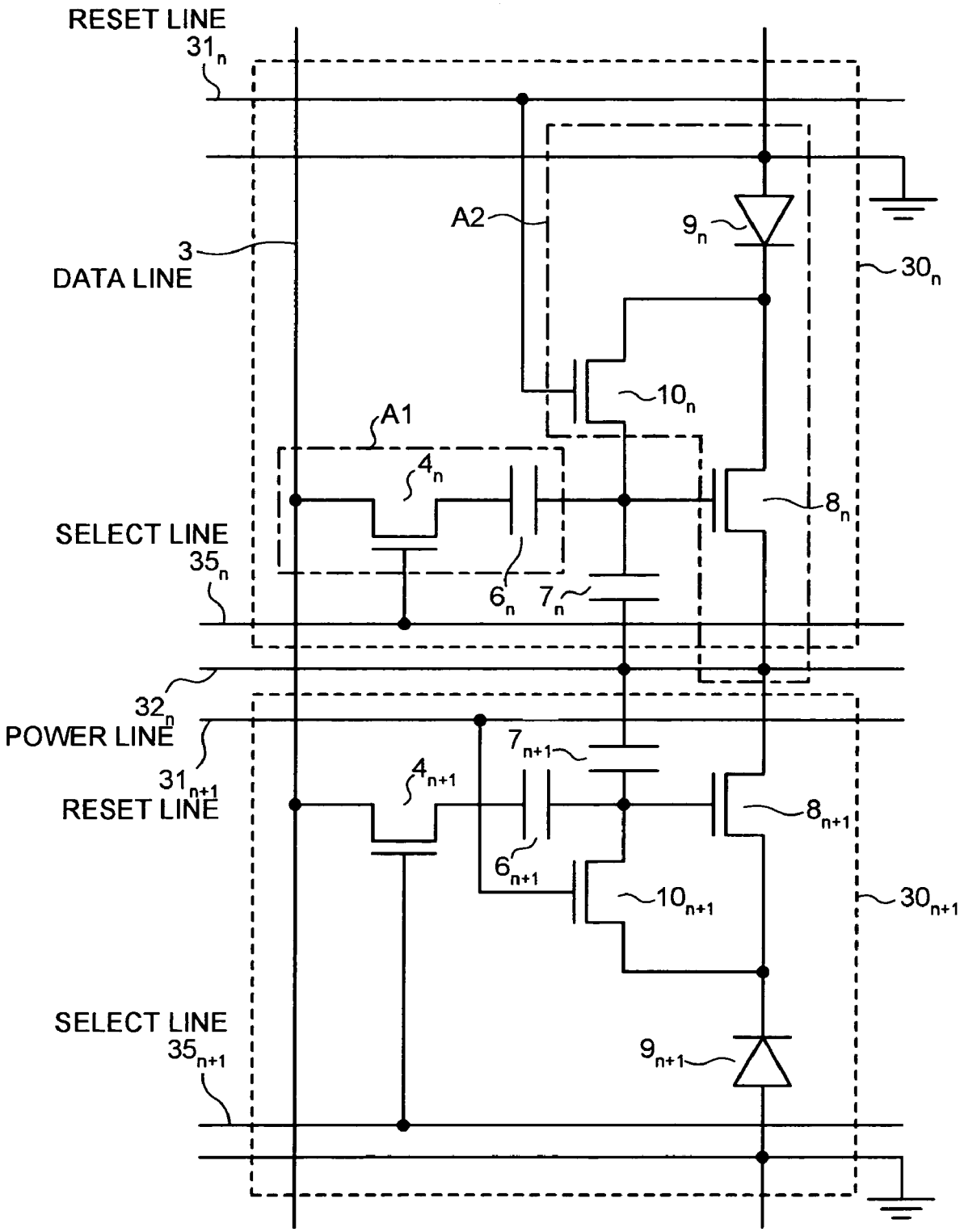
FIG. 5 is a circuit diagram of an arbitrary $n_{th}$ pixel circuit and an $(n+1)_{th}$ pixel circuit arranged in the same line as the $n_{th}$ pixel circuit in an adjacent row in an image display apparatus according to a second embodiment of the present invention.

FIG. 5 is a circuit diagram of an arbitrary $n_{th}$ pixel circuit $\mathbf{30}_n$ and an $(n+1)_{th}$ pixel circuit $\mathbf{30}_{n+1}$ arranged in the same line as the pixel circuit $\mathbf{30}_n$ and in an adjacent row, in the image display apparatus according to the second embodiment. The optional pixel circuit $\mathbf{30}_n$ includes the threshold-voltage detecting unit A2 having an organic LED $\mathbf{9}_n$ and a TFT $\mathbf{10}_n$, a capacitor $\mathbf{6}_n$, a capacitor $\mathbf{7}_n$, and a TFT $\mathbf{8}_n$ being the driver element. Further, the pixel circuit $\mathbf{30}_n$ includes the data line 3 and a TFT $\mathbf{4}_n$, and the data line 3 and the TFT $\mathbf{4}_n$ also serve as components of the reference-voltage writing unit A1. The pixel circuit $\mathbf{30}_n$ further includes a reset line $\mathbf{31}_n$ as a second scan line that controls the driven state of the TFT $\mathbf{10}_n$, and a select line $\mathbf{35}_n$ as a first scan line that controls the driven state of the TFT $\mathbf{4}_n$. Of the components described above, the respective components other than the data line 3 are provided respectively for each pixel circuit. The image display apparatus according to the second embodiment includes a power line $\mathbf{32}_n$, and has a configuration such that the power line $\mathbf{32}_n$ is shared by the pixel circuit $\mathbf{30}_n$ and the pixel circuit $\mathbf{30}_{n+1}$. The respective components will be explained below.

The data voltage and the zero voltage are alternately applied to the data line 3. The TFT $\mathbf{4}_n$ controls supply of the data voltage from the data line 3. The TFT $\mathbf{4}_n$ further controls supply of the zero voltage to the capacitor $\mathbf{6}_n$ by becoming the ON state at a timing when the zero voltage is applied from the data line 3. Therefore, the data line 3 also functions as a supply source of the reference voltage, and the TFT $\mathbf{4}_n$ functions as a first switching unit that controls supply of the data voltage and supply of the reference voltage, and hence the data line 3 and the TFT $\mathbf{4}_n$ constitute the reference-voltage writing unit A1. The driven state of the TFT $\mathbf{4}_n$ is controlled by the select line $\mathbf{35}_n$.

The power line $\mathbf{32}_n$ has a function of supplying the current to the organic LED $\mathbf{9}_n$ and an organic LED $\mathbf{9}_{n+1}$ at the time of emitting light, and inverting the polarity of voltage with respect to the polarity at the time of light emission to allow the current to flow through the TFT $\mathbf{8}_n$ and TFT $\mathbf{8}_{n+1}$ in a direction opposite to that at the time of light emission. A pixel circuit performing white display executes the preprocessing, and a pixel circuit performing black display executes the reset step described later, by inverting the polarity of voltage of the power line $\mathbf{32}_n$ with respect to the polarity at the time of light emission.

The capacitor $\mathbf{6}_n$, the capacitor $\mathbf{7}_n$, and the TFT $\mathbf{8}_n$ function in the same manner as in the image display according to the first embodiment, and the organic LED $\mathbf{9}_n$ and the TFT $\mathbf{10}_n$ function as the threshold-voltage detecting unit A2. The reset line $\mathbf{31}_n$ controls the driven state of the TFT $\mathbf{10}_n$.

The operation of the image display apparatus according to the second embodiment will be explained with reference to FIGS. 6 and 7A to 7D, taking an example in which the pixel circuit $\mathbf{30}_n$ performs white display and the pixel circuit $\mathbf{30}_{n+1}$ performs black display. The reference-voltage writing unit A1 and the threshold-voltage detecting unit A2 operate at a timing when the zero voltage is applied to the data line 3, and hence the pixel circuit $\mathbf{30}_n$ detects the threshold voltage.

Figure 6:
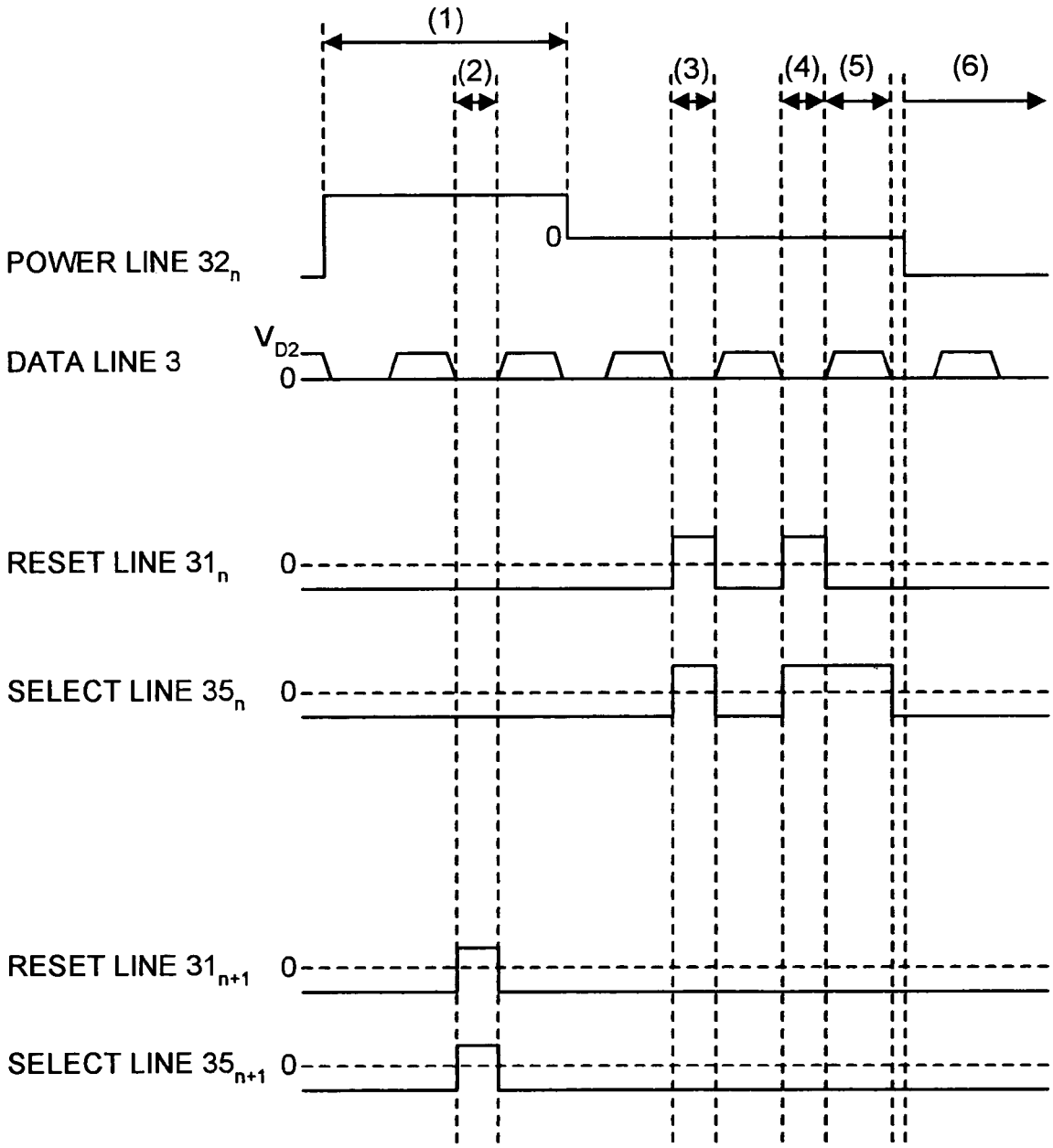
FIG. 6 is a timing chart of the pixel circuit shown in FIG. 5.
Figure 7A:
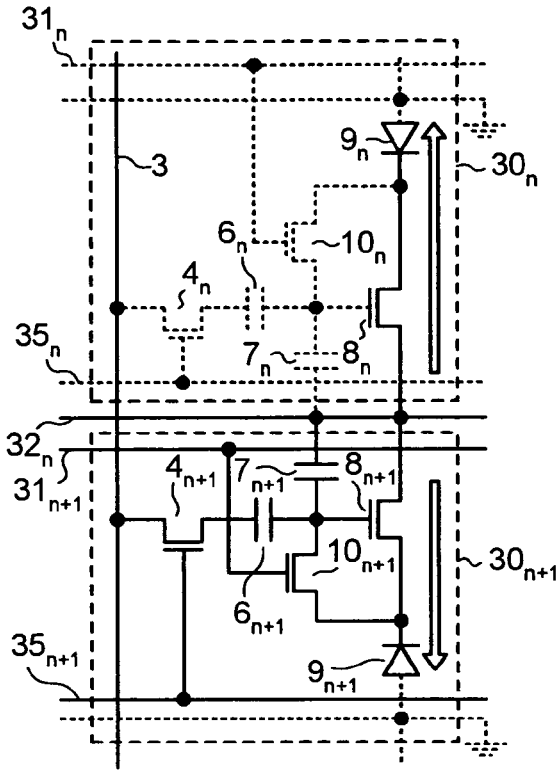
FIG. 7A is a circuit diagram for illustrating an operating process of the pixel circuit in periods (1) and (2) shown in FIG. 6.
Figure 7B:
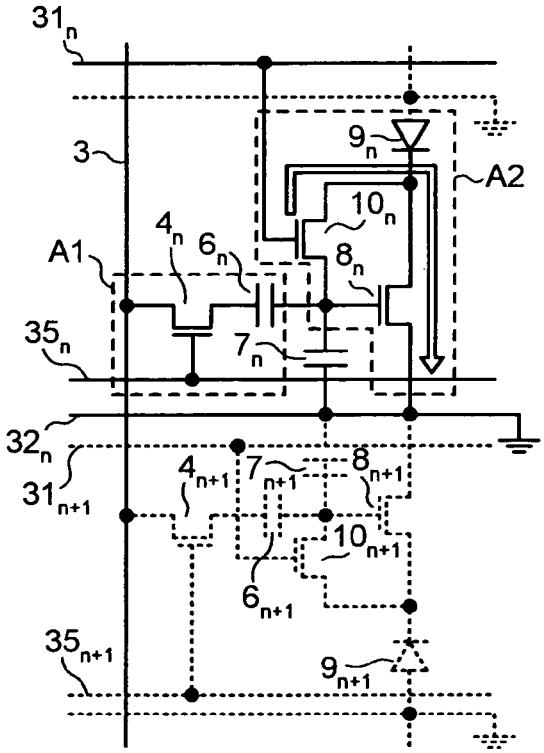
FIG. 7B is a circuit diagram for illustrating an operating process of the pixel circuit in a period (3) shown in FIG. 6.
Figure 7C:
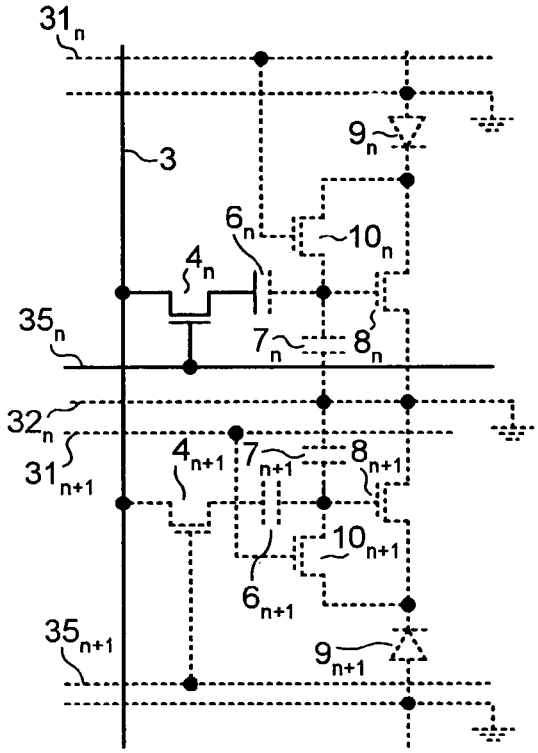
FIG. 7C is a circuit diagram for illustrating an operating process of the pixel circuit in a period (5) shown in FIG. 6.
Figure 7D:
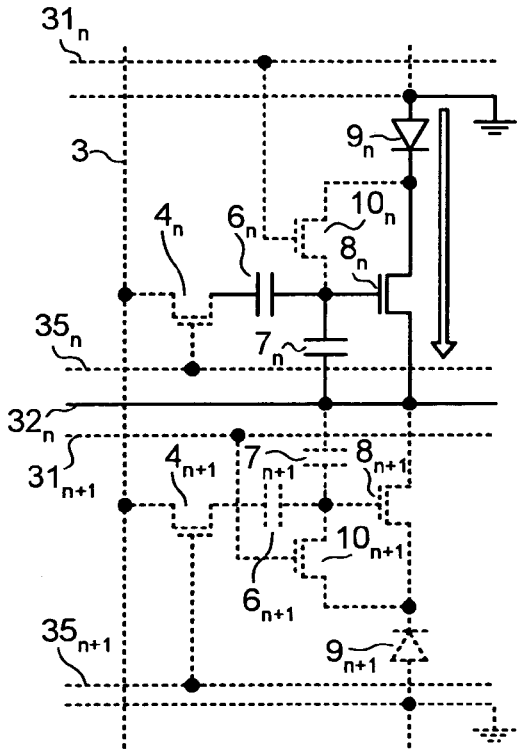
FIG. 7D is a circuit diagram for illustrating an operating process of the pixel circuit in a period (6) shown in FIG. 6.

FIG. 6 is a timing chart of the pixel circuit $\mathbf{30}_n$ and the pixel circuit $\mathbf{30}_{n+1}$ shown in FIG. 5. FIG. 7A is a circuit diagram for illustrating an operating process of the pixel circuit in periods (1) and (2) shown in FIG. 6; FIG. 7B is a circuit diagram for illustrating an operating process of the pixel circuit in a period (3); FIG. 7C is a circuit diagram for illustrating an operating process of the pixel circuit in a period (5); and FIG. 7D is a circuit diagram for illustrating an operating process of the pixel circuit in a period (6). A solid line indicates a current flowing region, and a broken line indicates a non-current flowing region.

The preprocessing step performed by the pixel circuit $\mathbf{30}_n$ and the reset step performed by the pixel circuit $\mathbf{30}_{n+1}$ will be explained with reference to FIGS. 6 and 7A. As shown in the period (1) in FIG. 6, by inverting the polarity of the voltage of the power line $\mathbf{32}_n$ with respect to the polarity at the time of light emission and setting the polarity to the high level, the current flows through the TFT $\mathbf{8}_n$ in the direction opposite to that at the time of light emission, thereby performing the preprocessing step for storing positive charges in the organic LED $\mathbf{9}_n$. On the other hand, in the pixel circuit $\mathbf{30}_{n+1}$, the current is made to flow through the TFT $\mathbf{8}_{n+1}$ in the direction opposite to that at the time of light emission to perform the reset step of removing the charges remaining in the organic LED $\mathbf{9}_{n+1}$. Specifically, in the pixel circuit $\mathbf{30}_{n+1}$, the current flows in the direction opposite to that at the time of light emission, and positive charges are supplied to the organic LED $\mathbf{9}_{n+1}$, to eliminate negative charges stored in the organic LED $\mathbf{9}_{n+1}$ at the time of light emission in the previous frame.

In the period (2) in FIG. 6, a black data writing step is performed in the pixel circuit $\mathbf{30}_{n+1}$. At this step, the TFT $\mathbf{4}_{n+1}$ and the TFT $\mathbf{10}_{n+1}$ are set to the ON state at a timing when the zero voltage is applied to the data line 3. When the TFT $\mathbf{10}_{n+1}$ becomes the ON state so that the gate electrode and the drain electrode of the TFT $\mathbf{8}_{n+1}$ become conductive to each other, electrons discharged from the organic LED $\mathbf{9}_{n+1}$ are supplied to the capacitor $\mathbf{7}_{n+1}$ connected to the gate electrode of the TFT $\mathbf{8}_{n+1}$, and negative charges are stored therein. Since the TFT $\mathbf{4}_{n+1}$ becomes the ON state when the zero voltage is applied to the data line 3, the zero voltage is supplied to the capacitor $\mathbf{6}_{n+1}$. As a result, since negative charges are held in the capacitor $\mathbf{6}_{n+1}$ and capacitor $\mathbf{7}_{n+1}$, negative voltage is applied to the gate electrode of the TFT $\mathbf{8}_{n+1}$. Therefore, even when the power line $\mathbf{32}_n$ is changed to the low level in the period (6) in FIG. 6, the pixel circuit $\mathbf{30}_{n+1}$ does not emit light and can perform black display. At this step, by applying negative voltage to the gate electrode of the TFT $\mathbf{8}_{n+1}$, the fluctuation margin of the threshold voltage in the TFT $\mathbf{8}_{n+1}$ can be reduced. That is, when positive voltage is applied to the gate electrode of the TFT $\mathbf{8}_{n+1}$ continuously for long time, fluctuations in the threshold voltage of the TFT $\mathbf{8}_{n+1}$ progress, but by executing this step, progress of fluctuations in the threshold voltage of the TFT $\mathbf{8}_{n+1}$ can be stopped, and the threshold voltage can be recovered. The pixel circuit $\mathbf{30}_{n+1}$ may perform the black data writing step for a plurality of times, so long as the zero voltage is applied to the data line 3 during the period (1) in FIG. 6.

The threshold voltage detecting step performed in the pixel circuit $\mathbf{30}_n$ will be explained with reference to FIG. 7B. During the period (3) in FIG. 6, the zero voltage is applied to the data line 3. In the pixel circuit $\mathbf{30}_n$, the reset line $\mathbf{31}_n$ and the select line $\mathbf{35}_n$ are set to the high level, and the TFT $\mathbf{4}_n$ and the TFT $\mathbf{10}_n$ are set to the ON state, at a timing when the zero voltage is applied to the data line 3. As a result, the reference-voltage writing unit A1 supplies the zero voltage to the capacitor $\mathbf{6}_n$ from the data line 3 via the TFT $\mathbf{4}_n$. On the other hand, the threshold-voltage detecting unit A2 sets the TFT $\mathbf{10}_n$ to the ON state so that the gate electrode and the drain electrode of the TFT $\mathbf{8}_n$ become conductive to each other, thereby detecting the threshold voltage of the TFT $\mathbf{8}_n$. As shown in the period (4) in FIG. 6, the threshold voltage detecting step can be performed a plurality of times, at a timing when the zero voltage is applied from the data line 3.

In the pixel circuit $\mathbf{30}_n$, as shown in FIG. 7C, the TFT $\mathbf{4}_n$ is set to the ON state at a timing when the data voltage $V_{D2}$ is applied to the data line 3, thereby performing the data writing step. Thereafter, in the pixel circuit $\mathbf{30}_n$, as shown in FIG. 7D, the light emitting step of making the organic LED $\mathbf{9}_n$ to emit light is performed, at which the power line $\mathbf{32}_n$ is set to the low level, so that the current flows through the TFT $\mathbf{8}_n$. As a result, in the pixel circuit $\mathbf{30}_n$, white display is performed. On the other hand, in the pixel circuit $\mathbf{30}_{n+1}$, since the black data writing step has been performed in the period (2) in FIG. 6, the TFT $\mathbf{8}_{n+1}$ stays in the OFF state, so as to perform black display. Thereafter, the operation of the pixel circuit $\mathbf{30}_n$ described above is performed in the pixel circuit $\mathbf{30}_{n+1}$ in order to perform white display, and the operation of the pixel circuit $\mathbf{30}_{n+1}$ is performed in the pixel circuit $\mathbf{30}_n$ in order to perform black display, thus the pixel circuit $\mathbf{30}_n$ and the pixel circuit $\mathbf{30}_{n+1}$ alternately repeat light emission.

In the image display apparatus according to the second embodiment, the threshold voltage detecting step is performed at a timing when the zero voltage is applied to the data line 3, during the period after the black display finishes and until the light emitting step is started, by using the fact that the zero voltage and the data voltage $V_{D2}$ are alternately applied to the data line 3. Therefore, the threshold voltage of the pixel circuit that performs white display can be detected, without shortening the light emitting time. Therefore, the optimum value of the refresh rate can be kept, and fluctuations in the threshold voltage of the driver element can be compensated.

Since the data line 3 and the TFT $\mathbf{4}_n$ function as the reference-voltage writing unit A1, it is not necessary to separately provide the TFT 13 included in the image display apparatus according to the first embodiment, and hence, the number of TFTs included in the pixel circuit can be reduced.

As shown in FIG. 5, the pixel circuit $\mathbf{30}_n$ and the pixel circuit $\mathbf{30}_{n+1}$ share the power line $\mathbf{32}_n$. Therefore, in the image display apparatus according to the second embodiment, the number of scan lines in the respective pixel circuits can be reduced to 3.5 lines, as compared with the image display apparatus according to the first embodiment, in which four scan lines are necessary.

In the period (1) in FIG. 6, as shown in FIG. 7A, the reset step is performed in the pixel circuit $\mathbf{30}_{n+1}$ that performs black display. The reason for performing the reset step is as described below. That is, in the light emitting step in the previous frame, electric charges are stored in the organic LED $\mathbf{9}_{n+1}$, as the current flows in the forward direction. If the charges remain therein, even when predetermined current flows through the organic LED $\mathbf{9}_{n+1}$ at the light emitting step, the remaining charges flow as a part of the current. As a result, the value of the current flowing in the organic LED $\mathbf{9}_{n+1}$ decreases by that amount, thereby decreasing the emission brightness. Therefore, in the image display apparatus according to the second embodiment, the reset step is performed for the pixel circuit $\mathbf{30}_{n+1}$ that performs black display, so that the remaining charges are eliminated by allowing the current to flow in a direction opposite to that at the time of light emission. Therefore, when the pixel circuit $\mathbf{30}_{n+1}$ performs white display, the organic LED $\mathbf{9}_{n+1}$ can emit light with desired brightness, without being affected by the charges stored in the previous frame.

The threshold voltage detecting step may be performed not only in the period (3) but also in the period (4) in FIG. 6. That is, the threshold voltage detecting step may be performed a plurality of times, during the period after the preprocessing step has finished and until the data writing step is started, and while the zero voltage is applied to the data line 3. Therefore, detection of the threshold voltage can be performed for long time, thereby enabling accurate detection of the threshold voltage of the TFT $\mathbf{8}_n$.

Figure 8:
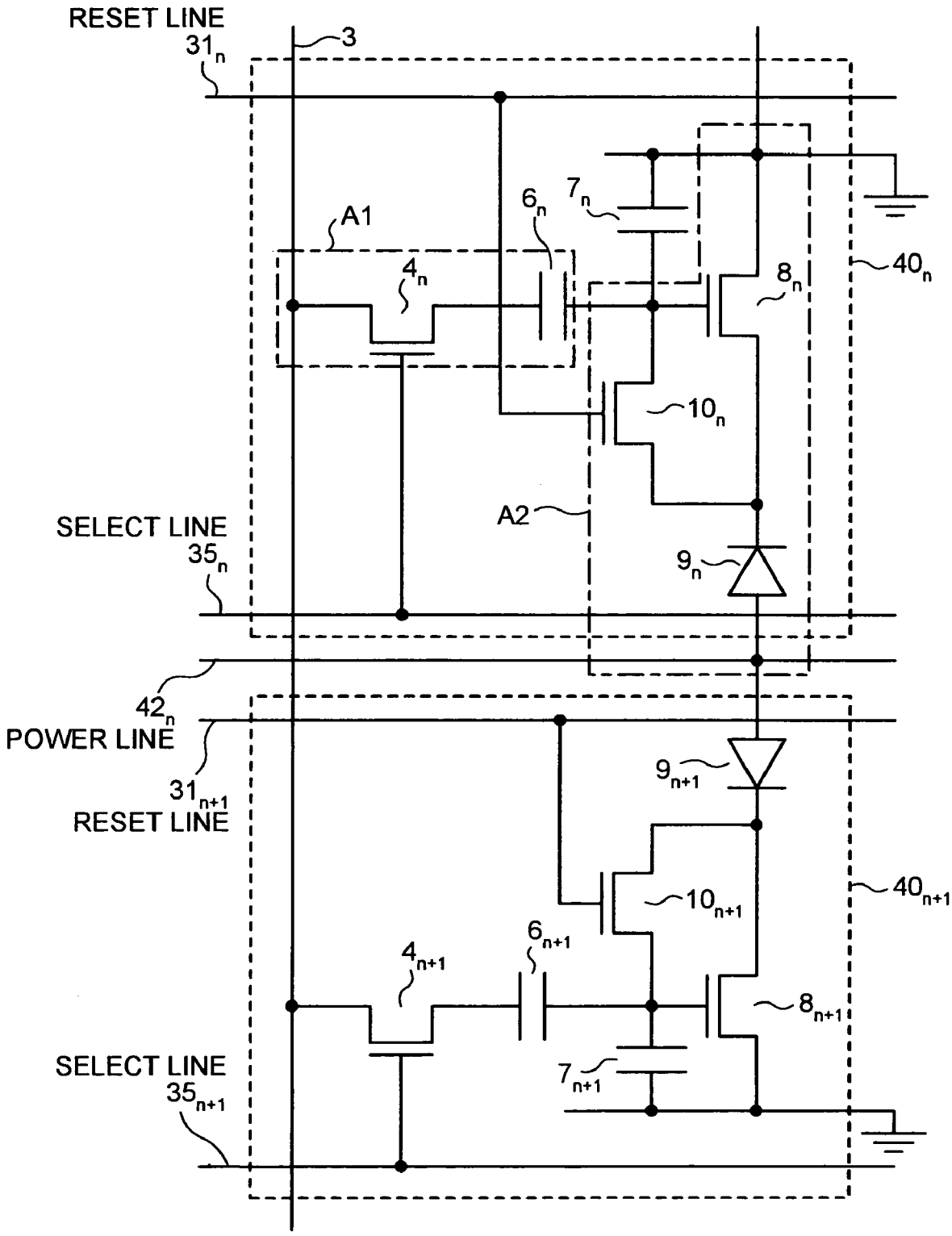
FIG. 8 is another circuit diagram of the pixel circuit according to the second embodiment.

The image display apparatus according to the second embodiment may have a configuration in which a power line $\mathbf{42}_n$ is connected to the anode sides of the organic LED $\mathbf{9}_n$ and the organic LED $\mathbf{9}_{n+1}$ as shown in FIG. 8, other than the configuration in which the power line $\mathbf{32}_n$ is connected to the source electrodes of the TFT $\mathbf{8}_n$ and the TFT $\mathbf{8}_{n+1}$. In this case, voltage of a polarity opposite to that of the voltage applied to the power line $\mathbf{32}_n$ shown in FIG. 6 is applied to the power line $\mathbf{42}_n$.

An image display apparatus according to a third embodiment of the present invention has a configuration in which a TFT as a first switching unit and a TFT as a second switching unit in an adjacent pixel circuit are controlled by one select line, thereby reducing the number of scan lines to be used.

Figure 9:
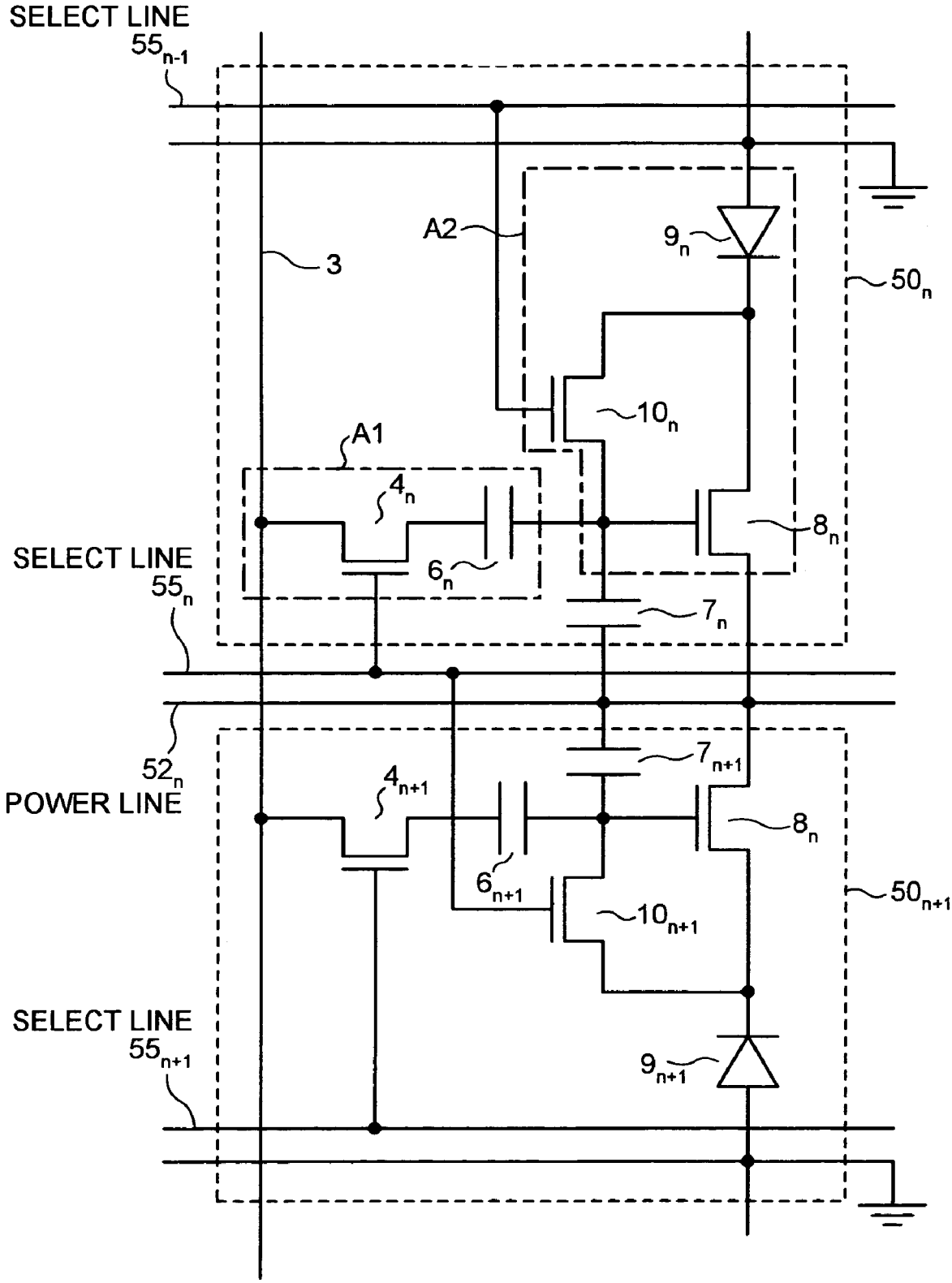
FIG. 9 is a circuit diagram of an arbitrary $n_{th}$ pixel circuit and an $(n+1)_{th}$ pixel circuit arranged in the same line as the $n_{th}$ pixel circuit in an adjacent row in an image display apparatus according to a third embodiment of the present invention.

FIG. 9 is a circuit diagram of an arbitrary $n_{th}$ pixel circuit $\mathbf{50}_n$ and an $(n+1)_{th}$ pixel circuit $\mathbf{50}_{n+1}$ arranged in the same line as the pixel circuit $\mathbf{50}_n$ and in an adjacent row, in the image display apparatus according to the third embodiment. A TFT $\mathbf{4}_n$ in the pixel circuit $\mathbf{50}_n$ and a TFT $\mathbf{10}_{n+1}$ in the pixel circuit $\mathbf{50}_{n+1}$ are both connected to a select line $\mathbf{55}_n$, being a third scan line. Therefore, when the select line $\mathbf{55}_n$ becomes the high level, the TFT $\mathbf{4}_n$ in the pixel circuit $\mathbf{50}_n$ and the TFT $\mathbf{10}_{n+1}$ in the pixel circuit $\mathbf{50}_{n+1}$ become the ON state at the same timing. Further, the driven state of the TFT $\mathbf{10}_n$ in the pixel circuit $\mathbf{50}_n$ is controlled by a select line $\mathbf{55}_{n-}1$. A power line $\mathbf{52}_n$ functions in the same manner as the power line $\mathbf{32}_n$ in the second embodiment.

Of the operations of the image display apparatus according to the third embodiment, a case of the pixel circuit $\mathbf{50}_n$ performing white display and the pixel circuit $\mathbf{50}_{n+1}$ performing black display will be explained, with reference to FIGS. 10 and 11A to 11E.

Figure 10:
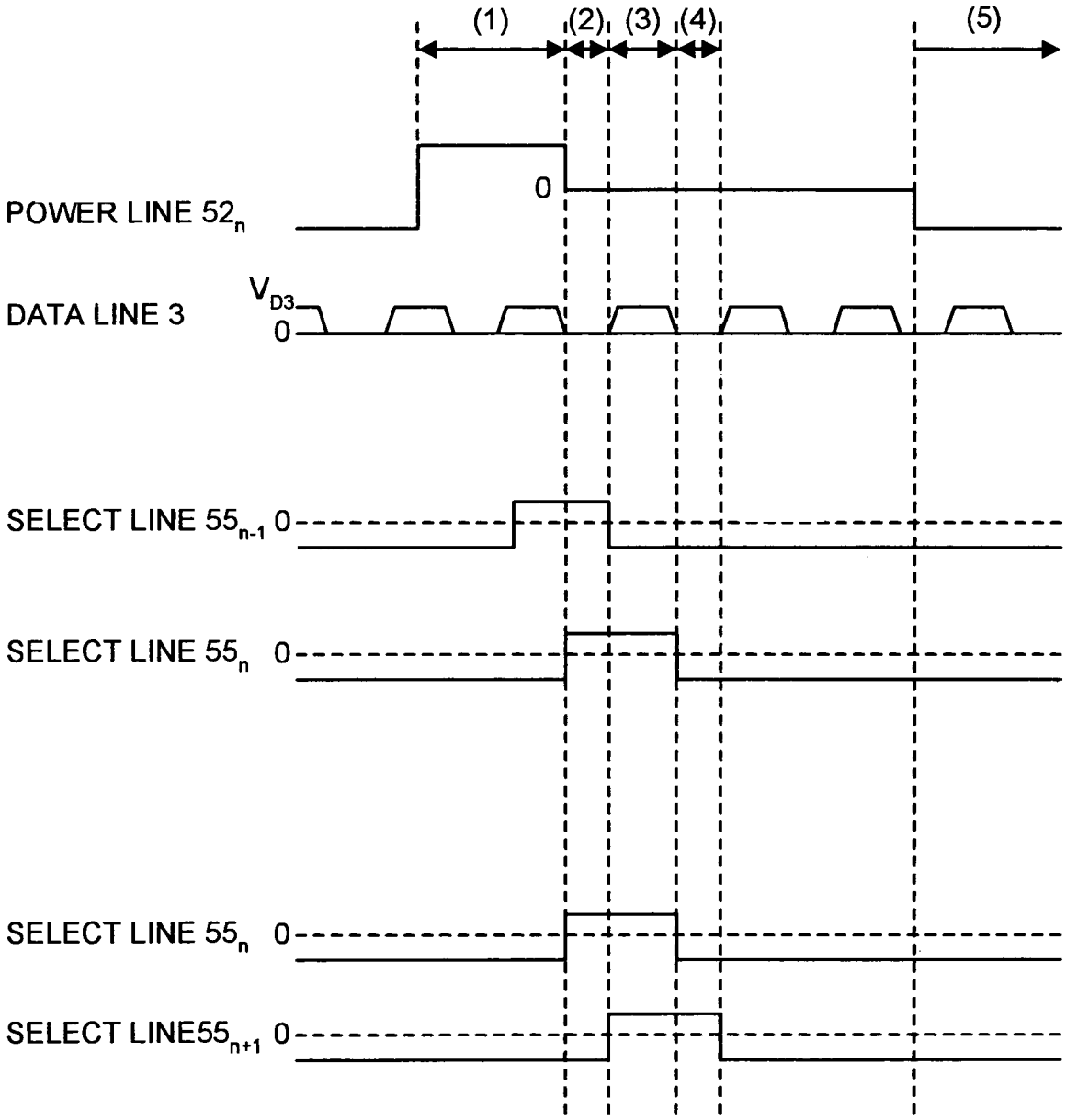
FIG. 10 is a timing chart of the pixel circuit shown in FIG. 9.
Figure 11A:
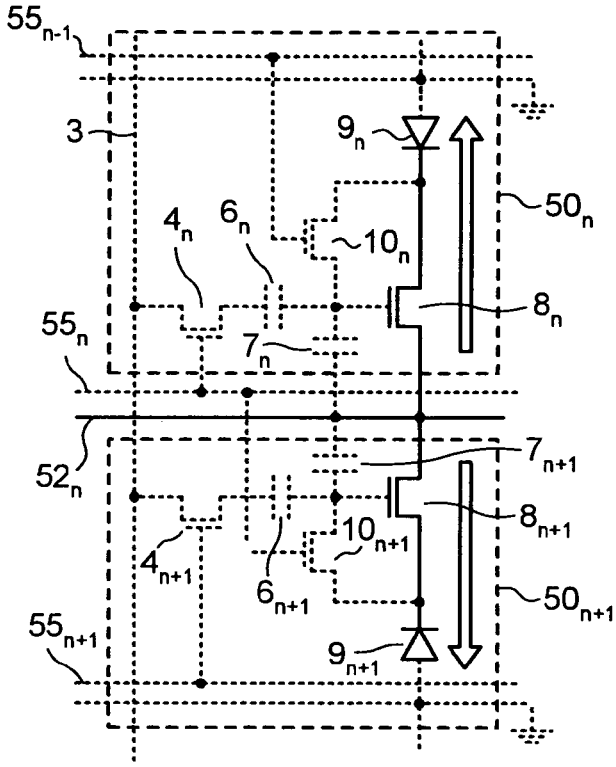
FIG. 11A is a circuit diagram for illustrating an operating process of the pixel circuit in a period (1) shown in FIG. 10.
Figure 11B:
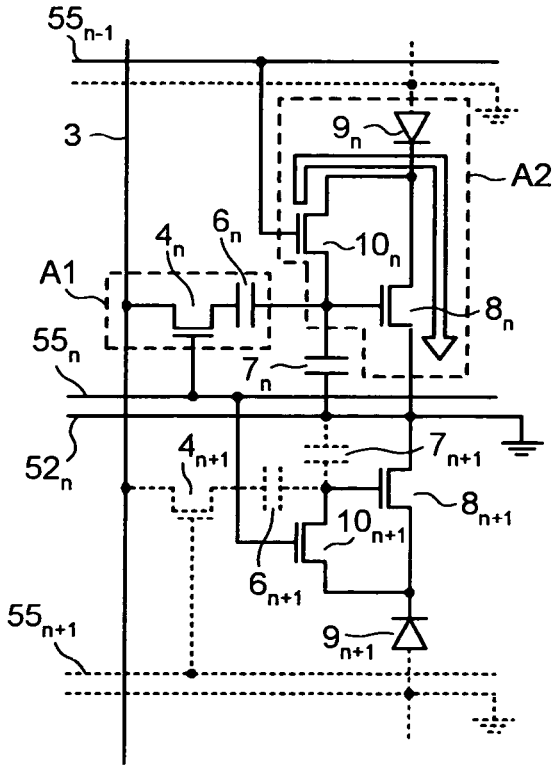
FIG. 11B is a circuit diagram for illustrating an operating process of the pixel circuit in a period (2) shown in FIG. 10.
Figure 11C:
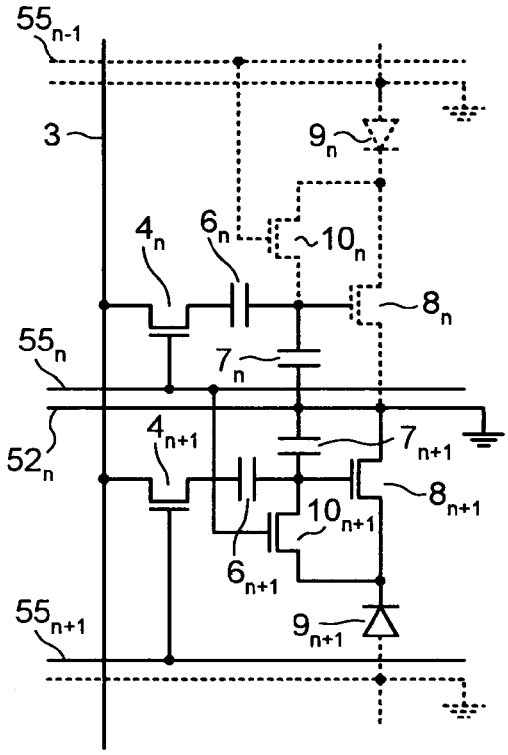
FIG. 11C is a circuit diagram for illustrating an operating process of the pixel circuit in a period (3) shown in FIG. 10.
Figure 11D:
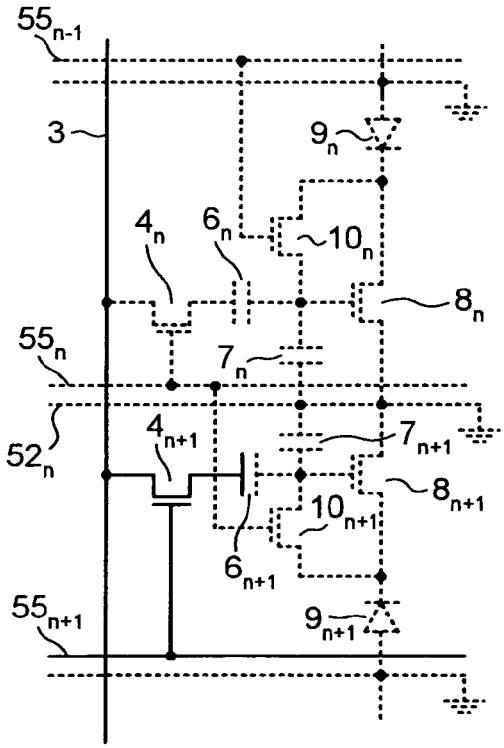
FIG. 11D is a circuit diagram for illustrating an operating process of the pixel circuit in a period (4) shown in FIG. 10.
Figure 11E:
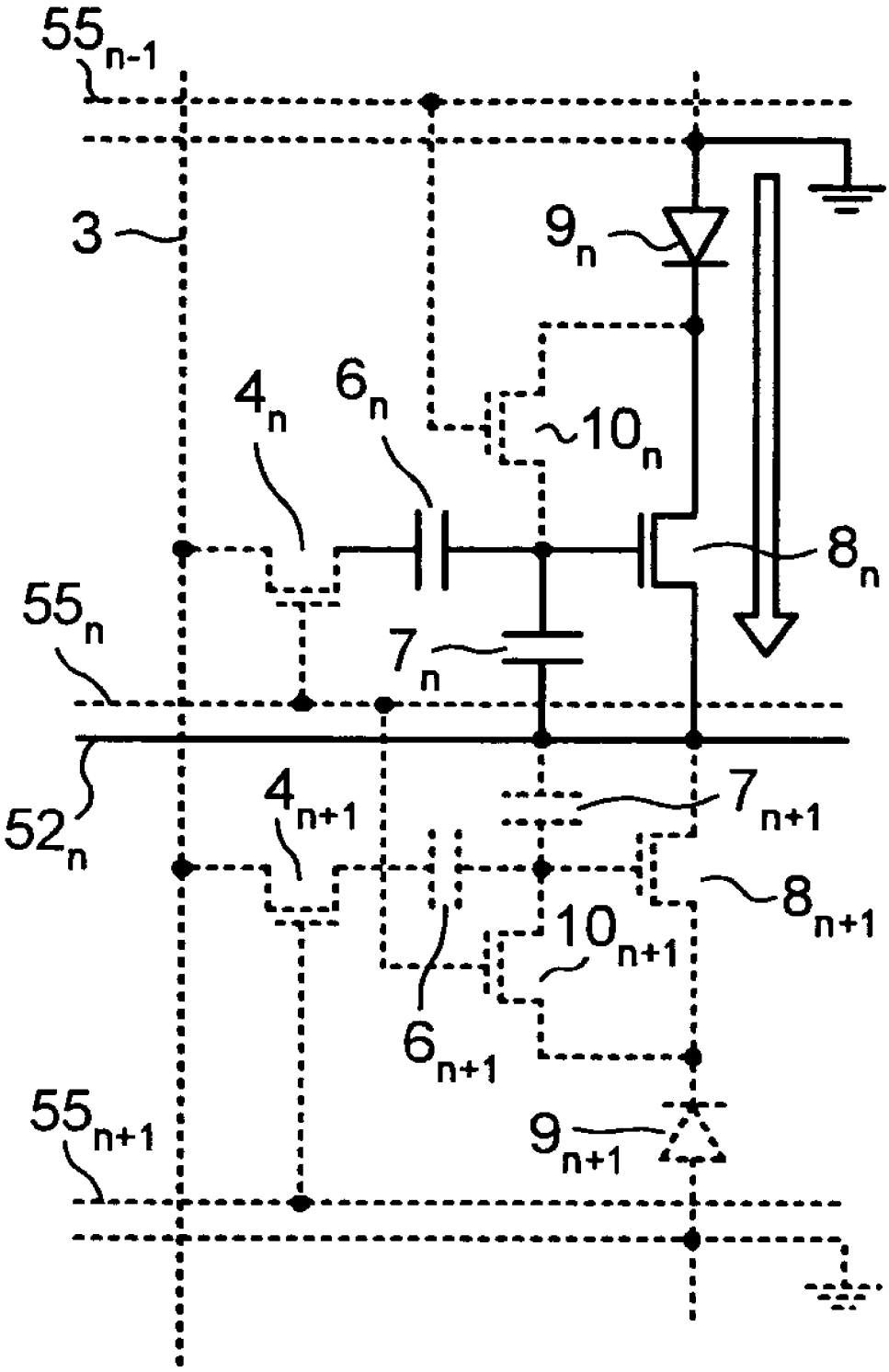
FIG. 11E is a circuit diagram for illustrating an operating process of the pixel circuit in a period (5) shown in FIG. 10.

FIG. 10 is a timing chart of the pixel circuit $\mathbf{50}_n$ and the pixel circuit $\mathbf{50}_{n+1}$ shown in FIG. 9. FIG. 11A is a circuit diagram for illustrating an operating process of the pixel circuit in a period (1) shown in FIG. 10; FIG. 11B is a circuit diagram for illustrating an operating process of the pixel circuit in a period (2); FIG. 11C is a circuit diagram for illustrating an operating process of the pixel circuit in a period (3); FIG. 11D is a circuit diagram for illustrating an operating process of the pixel circuit in a period (4); and FIG. 11E is a circuit diagram for illustrating an operating process of the pixel circuit in a period (5). A solid line indicates a current flowing region, and a broken line indicates a non-current flowing region.

As shown in FIG. 11A, in the period (1) in FIG. 10, by applying a voltage of a polarity opposite to that at the time of light emission to the power line $\mathbf{52}_n$ to set the power line $\mathbf{52}_n$ to the high level, the preprocessing step is performed in the pixel circuit $\mathbf{50}_n$, and the reset step is performed in the pixel circuit $\mathbf{50}_{n+1}$. Thereafter, after the select line $\mathbf{55}_{n-1}$ becomes the high level, and the TFT $\mathbf{10}_n$ constituting the threshold-voltage detecting unit A2 in the pixel circuit $50_n$ becomes the ON state, the power line $52_n$ is set to zero level.

In the period (2) in FIG. 10, the threshold voltage detecting step is performed in the pixel circuit $50_n$. The select line $55_n$ becomes the high level at a timing when the zero voltage is applied to the data line 3 constituting the reference-voltage writing unit A1. At this time, as shown in FIG. 11B, in the pixel circuit $50_n$, since the TFT $4_n$ becomes the ON state, the reference-voltage writing unit A1 supplies the zero voltage to the capacitor $6_n$, and the threshold-voltage detecting unit A2 performs the threshold voltage detecting step. When the select line $55_{n-1}$ becomes the low level and the TFT $110_n$ becomes the OFF state, the threshold voltage detecting step finishes. Since the select line $55_n$ stays in the high level, the TFT $4_n$ maintains the ON state.

In the period (3) in FIG. 10, the data writing step is performed in the pixel circuit $50_n$. That is, in the period (3) in FIG. 10, the applied voltage to the data line 3 changes to the data voltage $V_{D3}$, and as shown in FIG. 11C, in the pixel circuit $50_n$, the data voltage $V_{D3}$ is supplied to the capacitor $6_n$ from the data line 3 via the TFT $4_n$ keeping the ON state. Thereafter, when the select line $55_n$ becomes the low level, and the TFT $4_n$ becomes the OFF state, the data writing step in the pixel circuit $50_n$ finishes.

In the period (4) in FIG. 10, the zero voltage is applied to the data line 3, and black data writing step is performed in the pixel circuit $50_{n+1}$. As shown in FIG. 11D, in the pixel circuit $50_{n+1}$, since the ON state of the TFT $4_{n+1}$ is maintained, the zero voltage is supplied from the data line 3 to the capacitor $6_{n+1}$.

In the period (5) in FIG. 10, when the power line $52_n$ becomes the low level, the pixel circuit $50_n$ allows the current to flow through the TFT $8_n$, to perform the light emitting step. On the other hand, the pixel circuit $50_{n+1}$ performs black display.

The image display apparatus according to the third embodiment exhibits the same effect as that of the image display apparatus according to the second embodiment, and further, the number of the scan lines can be reduced by controlling the TFT $4_n$ in the pixel circuit $50_n$ and the TFT $10_{n+1}$ in the pixel circuit $50_{n+1}$ by one select line $55_n$. Further, since the current flowing through the select line $55_n$ needs only to be able to control the driven state of the TFT $4_n$ and the TFT $10_{n+1}$, it is not necessary to increase the line width of the select line $55_n$. Therefore, in the image display apparatus according to the third embodiment, the number of scan lines in each pixel circuit can be reduced to 2.5 lines, as compared with the image display apparatus according to the second embodiment, which requires 3.5 scan lines.

Figure 12:
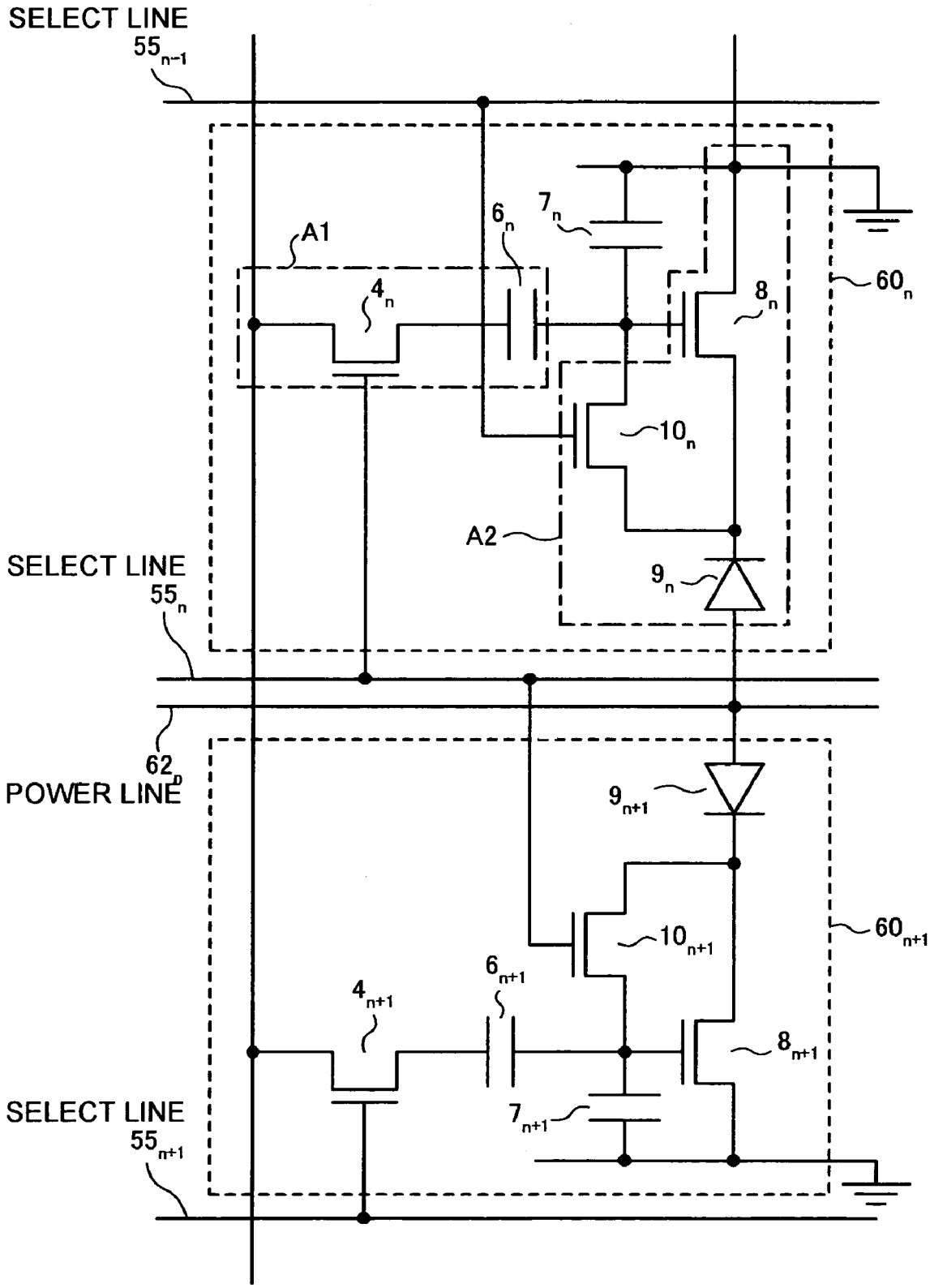
FIG. 12 is another circuit diagram of the pixel circuit according to the third embodiment.

The image display apparatus according to the third embodiment may have a configuration such that a common power line $62_n$ is connected to the anode sides of the organic LED $9_n$ and the organic LED $9_{n+1}$, as shown in FIG. 12, other than the configuration in which the power line $52_n$ is connected to the source electrodes of the TFT $8_n$ and the TFT $8_{n+1}$. In this case, voltage indicating a polarity opposite to that of the voltage applied to the power line $52_n$ shown in FIG. 10 is applied to the power line $62_n$.

In the second and the third embodiments, after the pixel circuit finishes the light emitting step, the preprocessing step is performed in the pixel circuit that emits light next. However, in a fourth embodiment of the present invention, while the light emitting step is performed in a pixel circuit, the preprocessing step is performed in a pixel circuit that emits light next.

Figure 13:
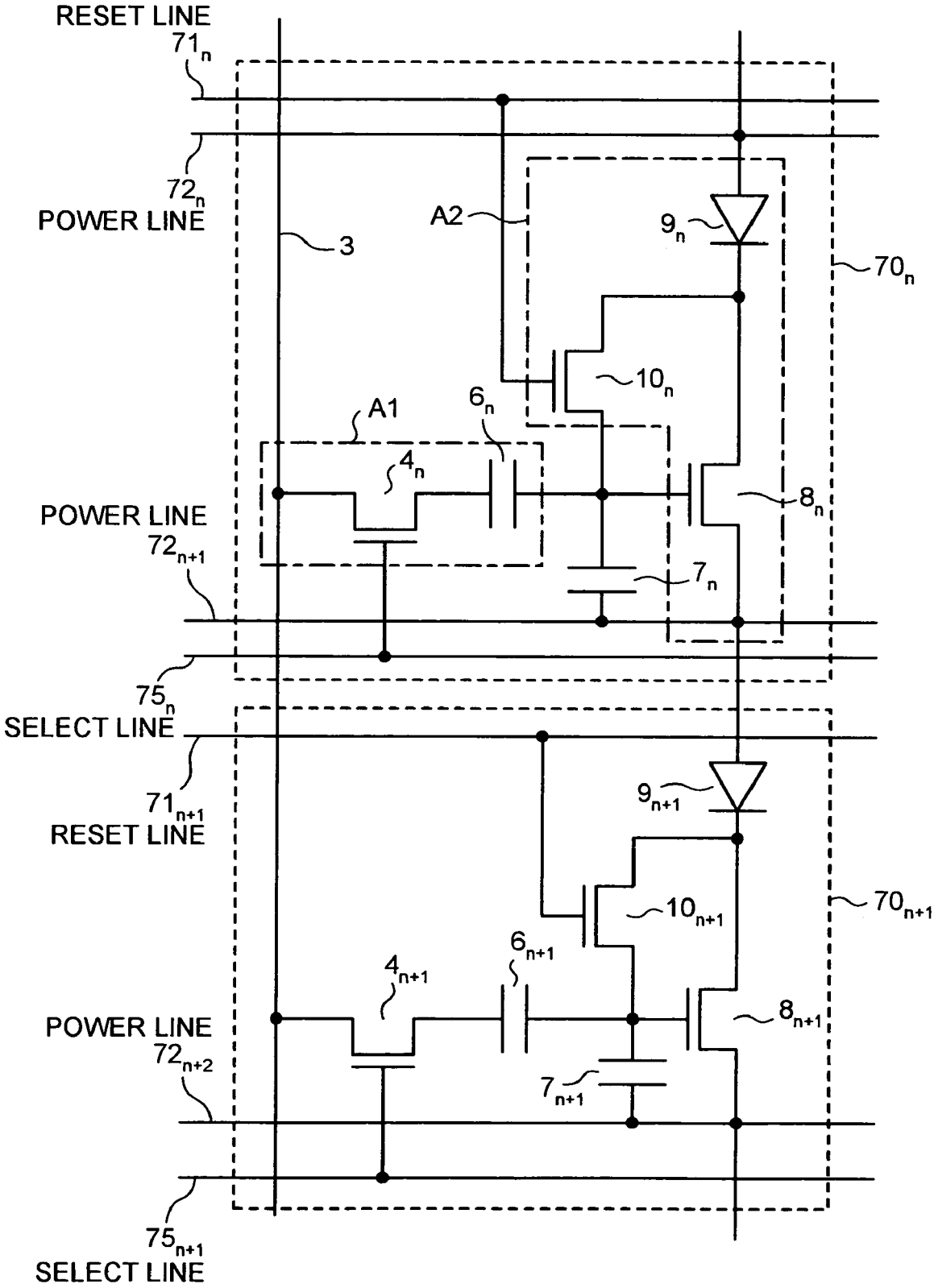
FIG. 13 is a circuit diagram of an arbitrary $n_{th}$ pixel circuit and an $(n+1)_{th}$ pixel circuit arranged in the same line as the $n_{th}$ pixel circuit in an adjacent row in an image display apparatus according to a fourth embodiment of the present invention.

FIG. 13 is a circuit diagram of an arbitrary $n_{th}$ pixel circuit $70_n$ and an $(n+1)_{th}$ pixel circuit $70_{n+1}$ arranged in the same line as the pixel circuit $70_n$ and in an adjacent row, in the image display apparatus according to the fourth embodiment. The image display apparatus according to the fourth embodiment has a configuration such that a reset line $71_n$, a power line $72_n$, and a select line $75_n$ are respectively provided for each pixel circuit.

The reset line $71_n$ controls the driven state of the TFT $10_n$ included in the pixel circuit $70_n$. The select line $75_n$ controls the driven state of the TFT $4_n$ included in the pixel circuit $70_n$.

The power line $72_n$ is connected to the anode side of the organic LED $9_n$ in the pixel circuit $70_n$, and the current in a predetermined direction flows through the organic LED $9_n$, due to a potential difference between the power line $72_n$ and the power line $72_{n+1}$ included in the pixel circuit $70_{n+1}$. Specifically, when the applied voltage to the power line $72_n$ is higher than that to the power line $72_{n+1}$, the current flows to the TFT $8_n$ from the drain electrode to the source electrode, so that the organic LED $9_n$ emits light. On the other hand, when the applied voltage to the power line $72_n$ is lower than that to the power line $72_{n+1}$, the current flows to the TFT $8_n$ from the source electrode to the drain electrode, so that the organic LED $9_n$ stores charges.

Of the operations of the image display apparatus according to the fourth embodiment, an instance when the pixel circuit $70_n$ performs white display and the pixel circuit $70_{n+1}$ performs black display will be explained, with reference to FIGS. 14 and 15A to 15C. In the image display apparatus according to the third embodiment, while the pixel circuit performing white display performs the light emitting step, the pixel circuit that emits light next is performing the preprocessing step.

Figure 14:
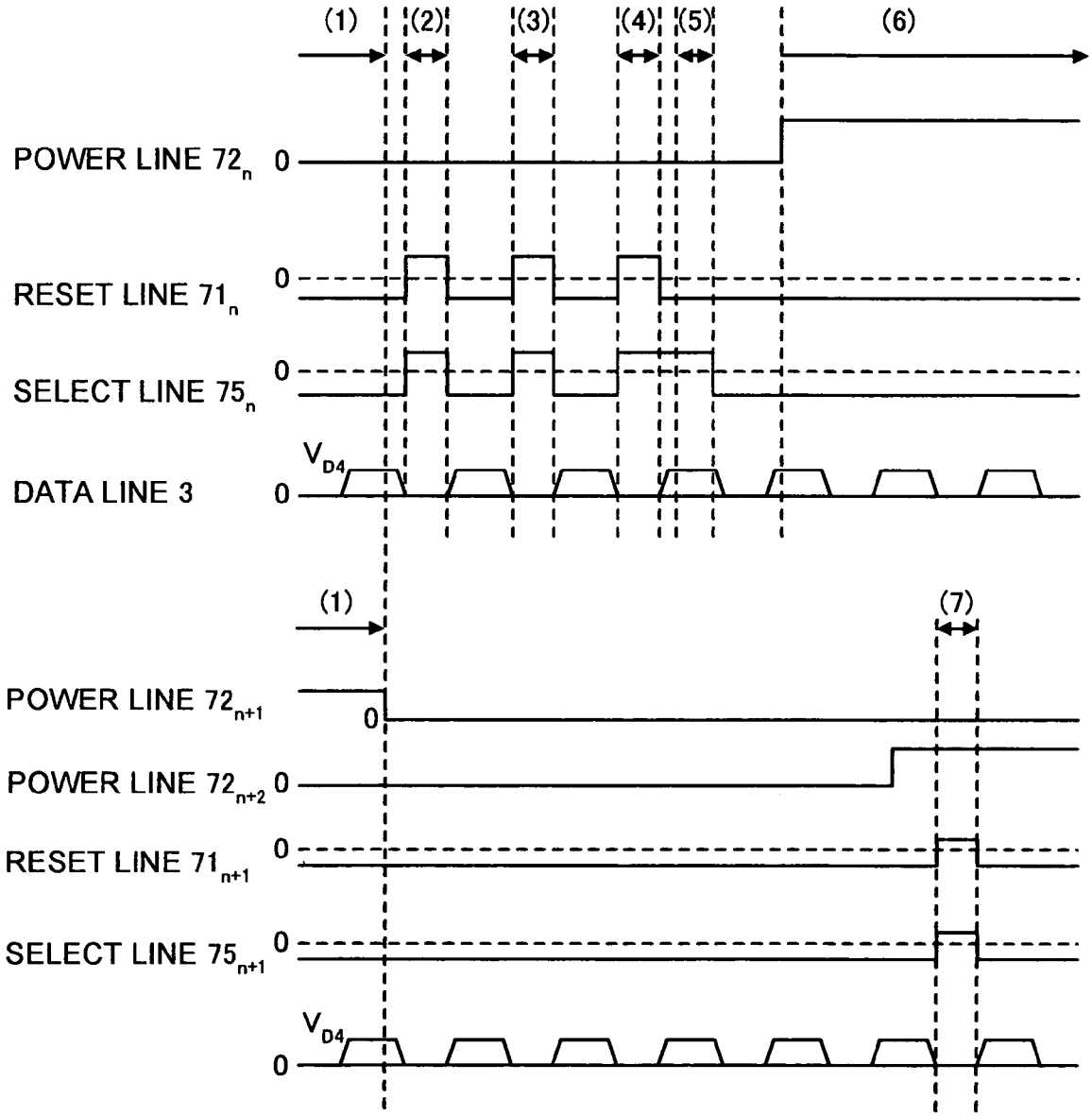
FIG. 14 is a timing chart of the pixel circuit shown in FIG. 13.
Figure 15A:
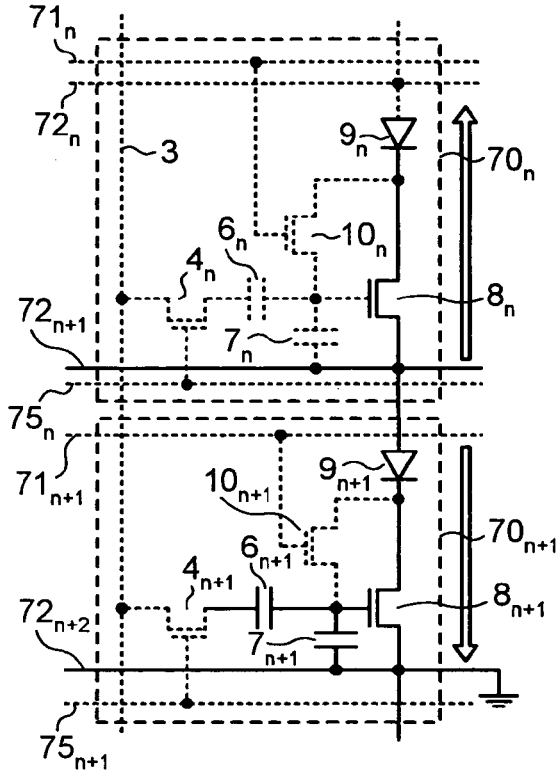
FIG. 15A is a circuit diagram for illustrating an operating process of the pixel circuit in a period (1) shown in FIG. 14.
Figure 15B:
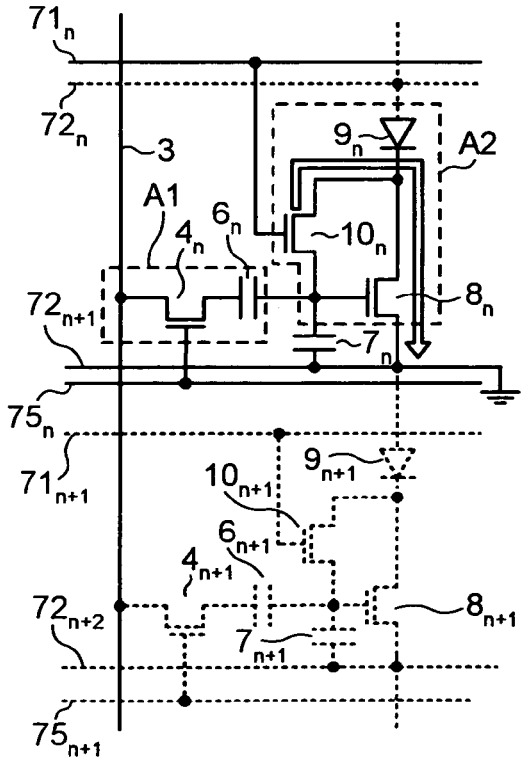
FIG. 15B is a circuit diagram for illustrating an operating process of the pixel circuit in a period (2) shown in FIG. 14.
Figure 15C:
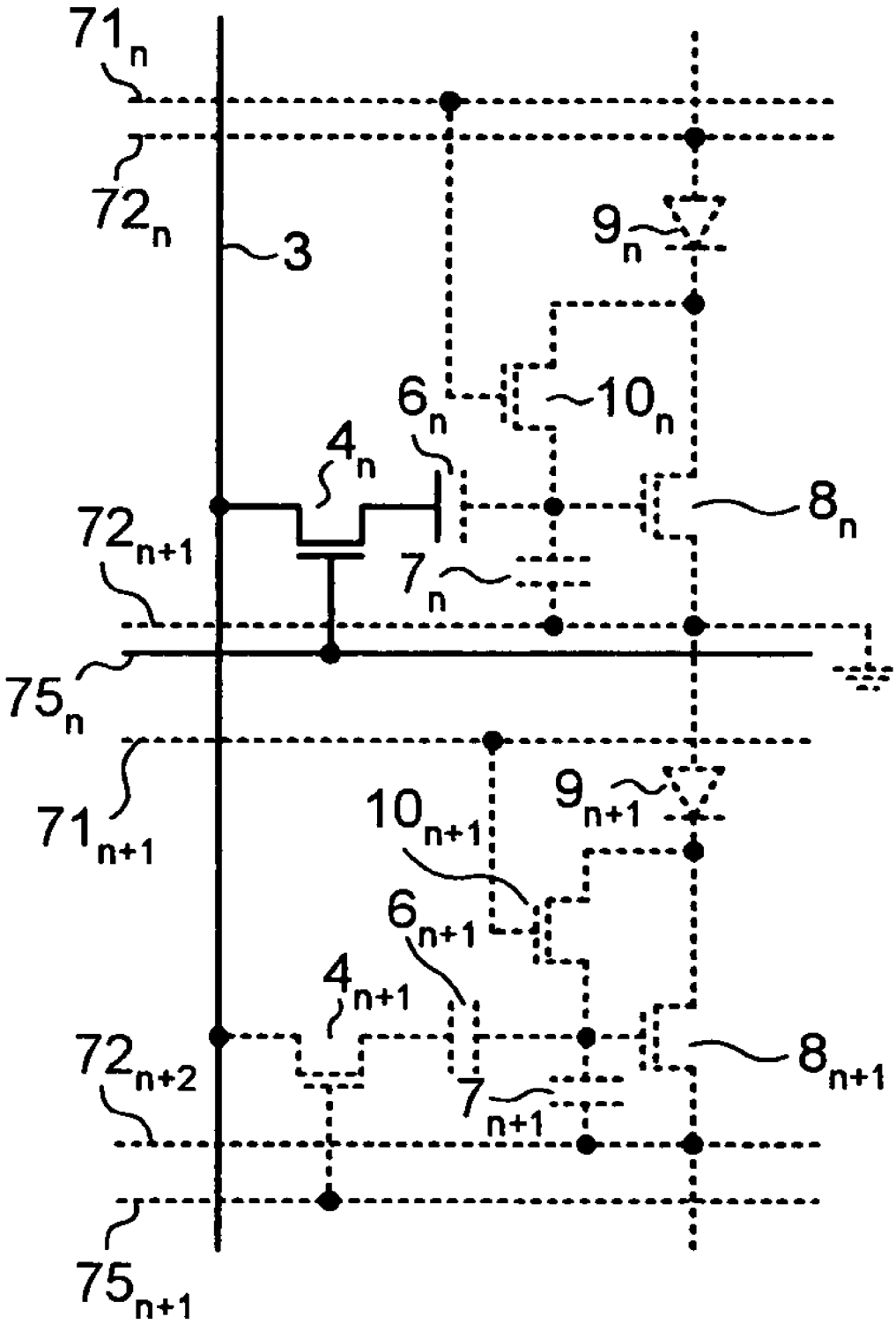
FIG. 15C is a circuit diagram for illustrating an operating process of the pixel circuit in a period (5) shown in FIG. 14.
Figure 16:
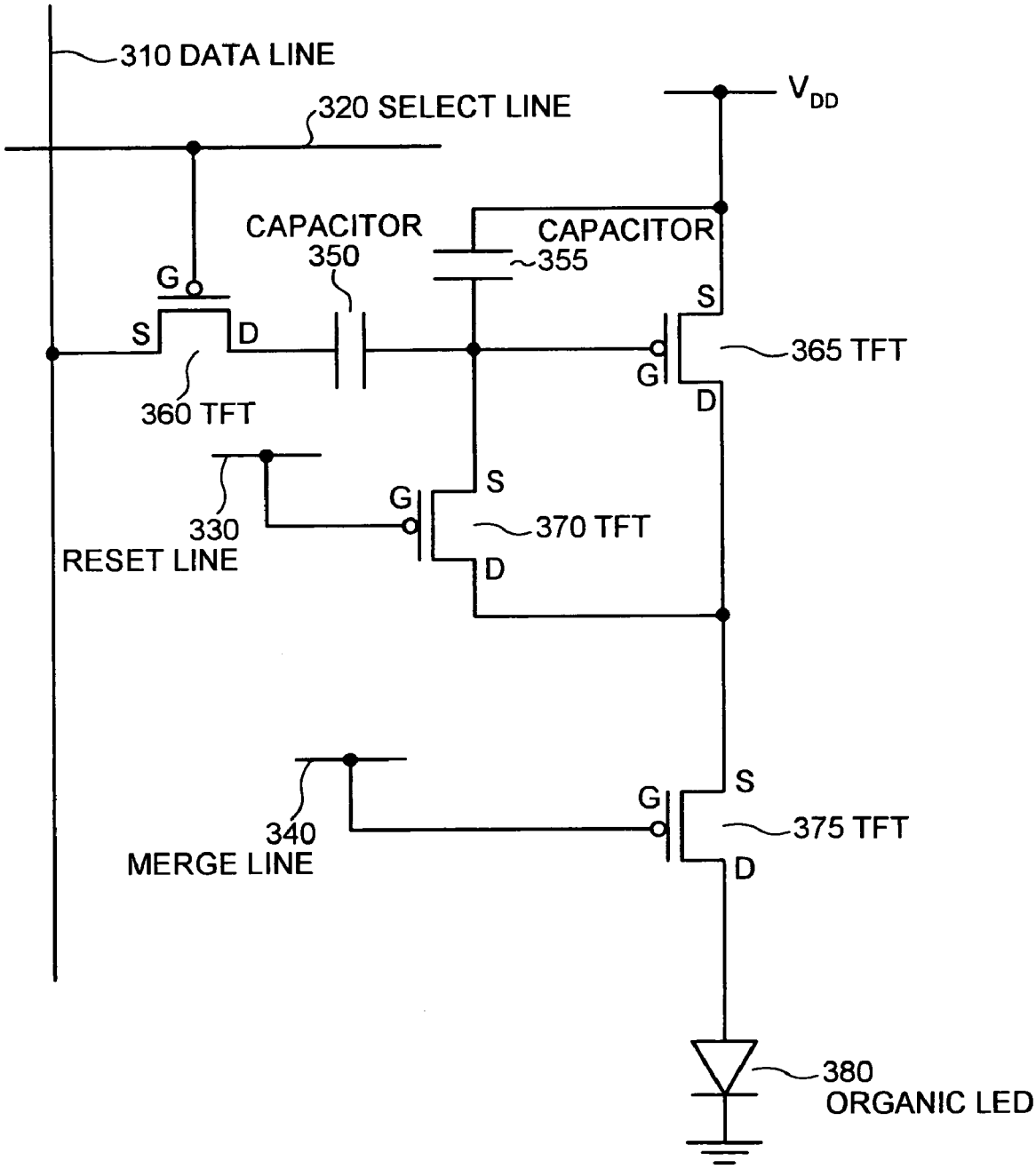
FIG. 16 a circuit diagram of a pixel circuit according to a conventional technology.
Figure 17A:
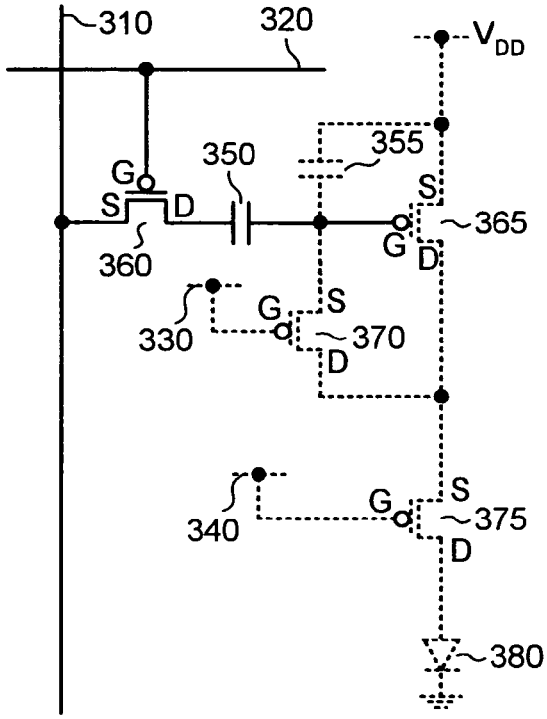
FIGS. 17A to 17D are circuit diagrams for illustrating operating processes of the pixel circuit shown in FIG. 16.
Figure 17B:
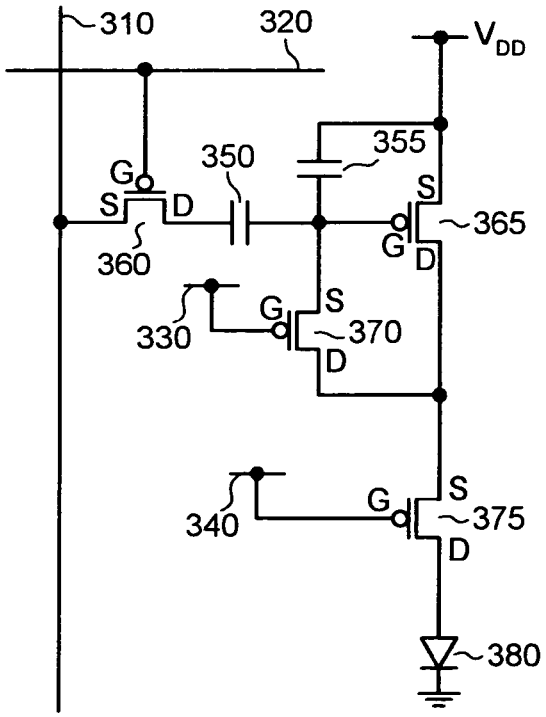
Figure 17C:
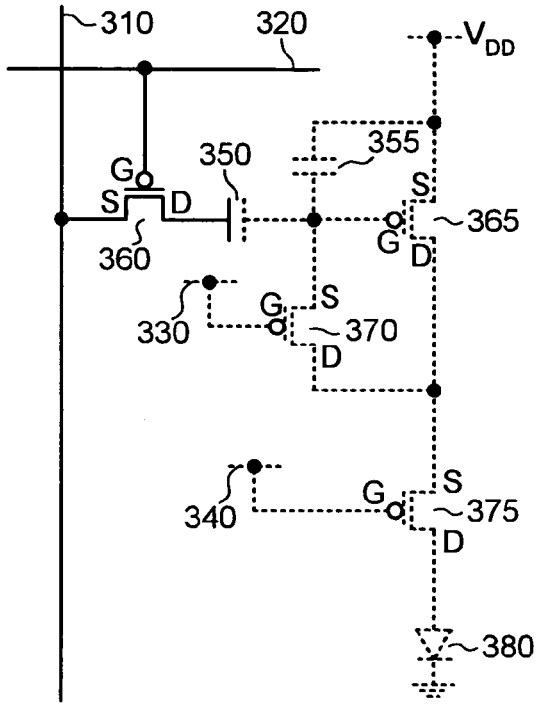
Figure 17D:
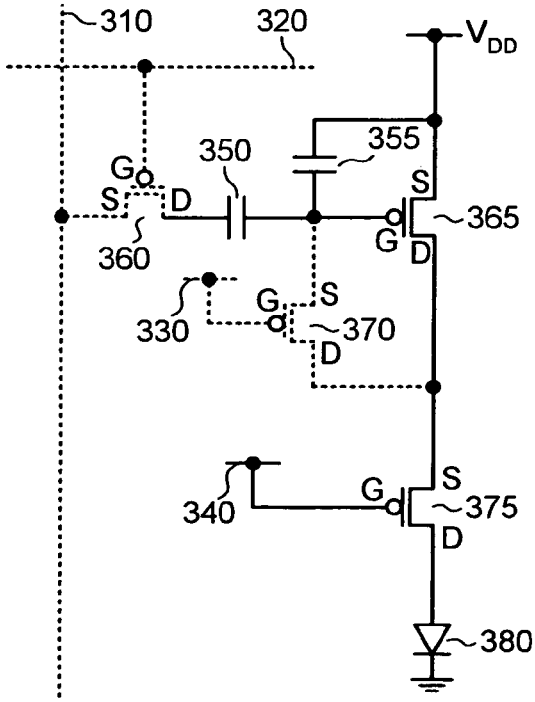

FIG. 14 is a timing chart of the pixel circuit $70_n$ and the pixel circuit $70_{n+1}$ shown in FIG. 13. FIG. 15A is a circuit diagram for illustrating an operating process of the pixel circuit in a period (1) shown in FIG. 14; FIG. 15B is a circuit diagram for illustrating an operating process of the pixel circuit in a period (2); and FIG. 15C is a circuit diagram for illustrating an operating process of the pixel circuit in a period (5). A solid line indicates a current flowing region, and a broken line indicates a non-current flowing region.

The state in which the pixel circuit $70_n$, which is to perform white display next, performs the preprocessing step, while the pixel circuit $70_{n+1}$ performs the light emitting step will be explained with reference to FIGS. 14 and 15A. In the period (1), the pixel circuit $70_{n+1}$ sets the power line $72_{n+1}$ to the high level to allow the current to flow from the drain electrode to the source electrode of the TFT $8_{n+1}$ so as to perform the light emitting step for allowing the organic LED $9_{n+1}$ to emit light. On the other hand, in the pixel circuit $70_n$, since the power line $72_n$ keeps the zero level, the current flows to the TFT $8_n$ from the source electrode to the drain electrode, and hence the current flows to the organic LED $9_n$ in a direction opposite to the direction at the time of emitting light. Therefore, the pixel circuit $70_n$ performs the preprocessing step of storing charges in the organic LED $9_n$.

In the period (2), as shown in FIG. 15B, the pixel circuit $70_n$ performs the threshold voltage detecting step. As shown in the periods (3) and (4), the threshold voltage detecting step can be executed a plurality of times, by setting the select line $75_n$ and the reset line $71_n$ to the high level, at a timing when the zero voltage is applied to the data line 3.

In the period (5), as shown in FIG. 15C, by keeping the select line $75_n$ at the high level, during the period in which the data voltage $V_{D4}$ is applied to the data line 3, the pixel circuit $70_n$ performs the data writing step.

In the period (6), the pixel circuit $\mathbf{70}_n$ performs the light emitting step by setting the power line $\mathbf{72}_n$ to the high level to allow the current to flow through the TFT $\mathbf{8}_n$. On the other hand, since the current flows to the pixel circuit $\mathbf{70}_{n+1}$ in a direction opposite to that of the current flowing at the time of light emitting step, the organic LED $\mathbf{9}_{n+1}$ does not emit light and performs black display. Further, since the current flows to the organic LED $\mathbf{9}_{n+}$in a direction opposite to that of the current flowing at the time of emitting light, the pixel circuit $\mathbf{70}_{n+1}$ performs the preprocessing step. In the period (7) in FIG. 14, the pixel circuit $\mathbf{70}_{n+1}$ performs the reset step by setting the TFT $\mathbf{4}_{n+1}$ and the TFT $\mathbf{10}_{n+1}$ to the ON state. Since the TFT $\mathbf{10}_{n+1}$ becomes the ON state, the gate electrode and the drain electrode of the TFT $\mathbf{8}_{n+1}$ become conductive to each other, and negative charges are stored in the capacitor $\mathbf{7}_{n+1}$ connected to the gate electrode of the TFT $\mathbf{8}_{n+1}$. Further, since the TFT $\mathbf{4}_{n+1}$ becomes the ON state, the zero voltage is supplied to the capacitor $\mathbf{6}_{n+1}$ from the data line 3. Therefore, charges remaining from the previous frame are eliminated.

The image display apparatus according to the fourth embodiment can simultaneously perform the light emitting step in a pixel circuit and the preprocessing step in a pixel circuit that performs white display next. Therefore, the time for performing the threshold voltage detecting step can be ensured for long time, without shortening the light emitting time, thereby enabling accurate detection of the threshold voltage. Therefore, an image display apparatus that can keep an optimum value of the refresh rate, can compensate fluctuations in the threshold voltage highly accurately, and can perform high-quality image display over a long period of time can be realized.

Further, the pixel circuit $\mathbf{70}_{n+1}$ that performs black display can eliminate charges remaining from the previous frame in the capacitor $\mathbf{6}_{n+1}$ and the capacitor $\mathbf{7}_{n+1}$ by performing the reset step. Therefore, the organic LED in the pixel circuit that performs white display can emit light with desired brightness, without being affected by the previous frame.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image display apparatus comprising a display pixel, wherein the display pixel includes a current-controlled light emitting element that emits light of brightness corresponding to current applied;

a driver element that includes a thin film transistor, and controls the current flowing through the current-controlled light emitting element;

a data line that supplies a voltage determined based on emission brightness;

a first switching unit that controls writing of the voltage supplied from the data line;

a first capacitor having a first electrode electrically connected to a gate electrode of the driver element, to hold a gate voltage of the driver element;

a reference-voltage writing unit that includes a supply source provided separately from the data line for supplying a predetermined reference voltage to a second electrode of the first capacitor; and a second switching unit that controls electrical conduction between the supply source and the second electrode of the first capacitor; and a threshold-voltage detecting unit that detects a threshold voltage of the driver element, including a third switching unit that controls electrical conduction between the gate electrode and a drain electrode of the driver element; and a capacitance for supplying charges to the drain electrode of the driver element.

2. The image display apparatus according to claim 1, wherein the threshold-voltage detecting unit detects the threshold voltage of the driver element based on a mechanism that the third switching unit is set to ON while the reference voltage is supplied to the second electrode of the first capacitor, the driver element is set to ON based on a gate-source voltage generated by electric charges accumulated in the capacitance, the gate-source voltage is dropped to the threshold voltage due to a decrease in the electric charges in the capacitance resulting from current flowing between a drain and a source of the driver element, and the driver element is set to OFF.

3. The image display apparatus according to claim 1, wherein the data line supplies the voltage determined based on emission brightness to the first capacitor, after the threshold-voltage detecting unit detects the threshold voltage.

4. The image display apparatus according to claim 1, further comprising a second capacitor having an electrode electrically connected to the first electrode of the first capacitor and the gate electrode of the driver element.

5. The image display apparatus according to claim 1, wherein the supply source includes a current supply source for the current-controlled light emitting element; and a charge supply source for the capacitance.

6. The image display apparatus according to claim 1, wherein the current-controlled light emitting element and the capacitance are formed by a single organic electroluminescence element.

7. The image display apparatus according to claim 1, further comprising a scan line that controls driven states of the second switching unit and the third switching unit.

8. An image display apparatus of an interlace system comprising a display pixel, wherein the display pixel includes a current-controlled light emitting element that emits light of brightness corresponding to current applied;

a driver element that includes a thin film transistor, and controls the current flowing through the current-controlled light emitting element;

a reference-voltage writing unit that writes the reference voltage in a first capacitor, including the first capacitor that holds a gate-source voltage of the thin film transistor;

a data line that supplies a voltage determined based on emission brightness and a predetermined reference voltage alternately; and a first switching unit that controls electrical conduction between the data line and the first capacitor; and a threshold-voltage detecting unit that detects a threshold voltage of the driver element, including a second switching unit that controls electrical conduction between a gate electrode and a drain electrode of the driver element; and a capacitance that is formed by the current-controlled light emitting element, and supplies electric charges accumulated to the drain electrode of the driver element.

9. The image display apparatus according to claim 8, wherein the threshold-voltage detecting unit detects the threshold voltage of the driver element based on a mechanism that the driver element is set to the ON state based on a gate-source voltage generated by the electric charges accumulated in the capacitance when the reference voltage is supplied from the data line to the first capacitor, the gate-source voltage drops to the threshold voltage due to a decrease in the electric charges resulting from current flowing between a drain and a source of the driver element, and the driver element is set to OFF.

10. The image display apparatus according to claim 8, further comprising a second capacitor arranged between the first capacitor and the driver element.

11. The image display apparatus according to claim 8, further comprising a power line that applies a voltage in a forward direction to the current-controlled light emitting element to supply the current, and applies a voltage in a reverse direction to the current-controlled light emitting element so that the electric charges are accumulated in the capacitance.

12. The image display apparatus according to claim 11, wherein the power line is electrically connected to the current-controlled light emitting element in an n display pixel and the current-controlled light emitting element in an $m_{th}$ display pixel, where n and m are different positive integer, and supplies a voltage in same direction simultaneously to the $n_{th}$ current-controlled light emitting element and the $m_{th}$ current-controlled light emitting element.

13. The image display apparatus according to claim 11, wherein the power line is electrically connected to the current-controlled light emitting element in an $n_{th}$ display pixel and the current-controlled light emitting element in an $m_{th}$ display pixel, where n and m are different positive integer, and supplies a voltage in a forward direction to one of the current-controlled light emitting element in an $n_{th}$ display pixel and the current-controlled light emitting element in an $m_{th}$ display pixel to emit the light, while supplying a voltage in a reverse direction to other current-controlled light emitting element so that the electric charges are accumulated in the other current-controlled light emitting element.

14. The image display apparatus according to claim 8, further comprising:

a first scan line for controlling a driven state of the first switching unit; and a second scan line for controlling a driven state of the second switching unit.

15. The image display apparatus according to claim 8, further comprising a third scan line for controlling driven states of the first switching unit in an $n_{th}$ stage and the second switching unit in an $m_{th}$ stage.

16. An image display apparatus comprising a display pixel, wherein the display pixel includes a current-controlled light emitting element that emits light of brightness corresponding to current applied;

a driver element that includes a thin film transistor, and controls the current flowing through the current-controlled light emitting element;

a data line that supplies a voltage determined based on emission brightness;

a first switching unit that controls writing of the voltage supplied from the data line;

a first capacitor having a first electrode electrically connected to a gate electrode of the driver element, to hold a gate voltage of the driver element;

a reference-voltage writing unit that includes a second switching unit that controls electrical conduction between a supply source provided separately from the data line for supplying a predetermined reference voltage to a second electrode of the first capacitor and the second electrode of the first capacitor; and a threshold-voltage detecting unit that detects a threshold voltage of the driver element, including a third switching unit that controls electrical conduction between the gate electrode and a drain electrode of the driver element; and a capacitance for supplying charges to the drain electrode of the driver element.

* * * * *